US005770918A

United States Patent [19]

Kawate et al.

[11] Patent Number: 5,770,918

[45] Date of Patent: Jun. 23, 1998

[54] ELECTROCONDUCTIVE FRIT AND IMAGE-FORMING APPARATUS USING THE SAME

[75] Inventors: Shinichi Kawate, Sagamihra; Kazuhiro Ohki, Yokohama, both of Japan

[73] Assignee: Canon Kabushiki Kaisha, Tokyo, Japan

[21] Appl. No.: 585,352

[22] Filed: Jan. 11, 1996

[30] Foreign Application Priority Data

Jan. 5, 1996 [JP] Japan ..... 8-000186

[51] Int. Cl.[6] ..... H01B 1/08; H01J 1/88; H01J 63/02

[52] U.S. Cl. ..... 313/495; 252/514; 428/406

[58] Field of Search ..... 313/495, 496, 313/497; 252/514; 445/25; 106/1.14, 1.13, 1.15; 428/406; 257/794

[56] References Cited

U.S. PATENT DOCUMENTS

| | | | |
|---|---|---|---|
| 2,717,946 | 9/1955 | Peck | 252/514 |
| 3,619,287 | 11/1971 | Stankavich | 252/514 |
| 3,635,824 | 1/1972 | Brandes et al. | 252/514 |
| 3,718,608 | 2/1973 | Mason et al. | 252/514 |
| 3,846,345 | 11/1974 | Mason et al. | 252/514 |
| 4,374,344 | 2/1983 | Misono | 313/479 |
| 4,419,279 | 12/1983 | Abrams | 252/514 |
| 4,496,475 | 1/1985 | Abrams | 252/514 |
| 4,621,024 | 11/1986 | Wright | 428/406 |
| 4,624,865 | 11/1986 | Gindrup et al. | 428/406 |
| 4,647,402 | 3/1987 | Tamura | 252/514 |
| 5,007,872 | 4/1991 | Tang | 445/25 |
| 5,066,883 | 11/1991 | Yoshioka et al. | 313/309 |
| 5,180,888 | 1/1993 | Sugiyama et al. | 252/514 |
| 5,532,548 | 7/1996 | Spindt et al. | 313/495 |

FOREIGN PATENT DOCUMENTS

| | | | |
|---|---|---|---|
| 0523318 | 1/1993 | European Pat. Off. | H01J 9/26 |
| 56-30240 | 3/1981 | Japan | H01J 29/88 |
| 64-31332 | 2/1989 | Japan | H01J 29/48 |
| 02257551 | 10/1990 | Japan | H01J 31/15 |
| 02299136 | 12/1990 | Japan | H01J 29/86 |
| 949634 | 2/1964 | United Kingdom | H01B 1/16 |

OTHER PUBLICATIONS

International Electron Devices Meeting, M. Hartwell et al.,1975, "Strong Electron Emission From Patterned Tin–Indium Oxide Thin Films". pp. 519–521.

Journal Of Applied Physics, vol. 32, No. 4, Apr. 1961, C.A. Mead, "Operation of Tunnel–Emission Devices". pp. 646–652.

Journal Of Applied Physics, vo. 47, No. 12, Dec. 1976, C.A. Spindt, et al., "Physical Properties of Thin–Film Field Emission Cathodes with Molybdenum Cones". pp. 5248–5263.

Radio Engineering And Electronic Physics, M. I. Elinson et al., pp. 1290–1296, "The Emission of Hot Electrons and the Field Emission of Electrons from Tin Oxide". Jul. 1965.

Journal Of The Vacuum Society Of Japan, vol. 26, No. 1, H. Araki et al. "Electroforming and Electron Emission of Carbon Thin Films". pp. 22–29 1983 (no month).

Advances In Electronics And Electron Physics, vol. VIII, W.P. Dyke et al., "Field Emission". pp. 89–185 1956 (no month).

Thin Solid Films, G. Dittmer, 1972; "Electrical Conduction aand Electron Emission of Discontinuous Thin Films". pp. 317–329 (no month).

*Primary Examiner*—Sandra L. O'Shea
*Assistant Examiner*—Michael Day
*Attorney, Agent, or Firm*—Ftzpatrick, Cella, Harper & Scinto

[57] ABSTRACT

Electroconductive frit includes glass (14) having a low melting point and a filler of fine glass particles (12) coated on the surface with metal(13). The electroconductive frit is used for bonding a spacer to an electron source substrate and a face plate in an image-forming apparatus to ensure mechanical securing strength and electrical connection.

52 Claims, 15 Drawing Sheets

ELECTROCONDUCTIVE FRIT AND IMAGE-FORMING APPARATUS USING THE SAME

BACKGROUND OF THE INVENTION

1. Field of the Invention

This invention relates to a specific type of electroconductive frit (in the form of a powdery, pasty or baked material) and an image-forming apparatus realized by using such electroconductive frit.

2. Related Background Art

There are known various types of electroconductive frit including powdery mixtures of metal and glass. Japanese Patent Application Laid-Open No. 56-30240 discloses an electroconductive material that is a powdery mixture of silver and glass.

Meanwhile, an image-forming apparatus utilizing electrons typically comprises an envelope for maintaining a vacuum condition in the inside, an electron source for emitting electrons, a drive circuit for the electron source, an image-forming member having fluorescent bodies that fluoresce when hit by electrons, an accelerating electrode for accelerating the movement of electrons toward the image-forming member, a high voltage source for the accelerating electrode and other components.

A flat-type image-forming apparatus comprising a very flat envelope may be provided with spacers to make it withstand the atmospheric pressure. (See, inter alia, Japanese Patent Application Laid-Open No. 2-299136 filed by the applicant of the present patent application.)

Now, electron-emitting devices to be used for the electron source of an image-forming apparatus will be described.

There have been known two types of electron-emitting device; the thermionic electron emission type and the cold cathode electron emission type. Of these, the cold cathode emission type refers to devices including field emission type (hereinafter referred to as the FE type) devices, metal/insulation layer/metal type (hereinafter referred to as the MIM type) electron-emitting devices and surface conduction electron-emitting devices. Examples of FE type device include those proposed by W. P. Dyke & W. W. Dolan, "Field emission", Advance in Electron Physics, 8, 89 (1956) and C. A. Spindt, "Physical properties of thin-film field emission cathodes with molybdenum cones", J. Appl. Phys., 47, 5284 (1976).

Examples of MIM device are disclosed in papers including C. A. Mead, "The tunnel-emission amplifier", J. Appl. Phys., 32, 646 (1961).

Examples of surface conduction electron-emitting device include one proposed by M. I. Elinson, Radio Eng. Electron Phys., 10 (1965).

A surface conduction electron-emitting device is realized by utilizing the phenomenon that electrons are emitted out of a small thin film formed on a substrate when an electric current is forced to flow in parallel with the film surface.

While Elinson proposes the use of $SnO_2$ thin film for a device of this type, the use of Au thin film is proposed in G. Dittmer: "Thin Solid Films", 9, 317 (1972), whereas the use of $In_2O_3/SnO_2$ thin film and that of carbon thin film are discussed respectively in M. Hartwell and C. G. Fonstad, "IEEE Trans. ED Conf.", 519 (1975) and in H. Araki et al., "Vacuum", Vol. 26, No. 1, p. 22 (1983).

FIG. 13 of the accompanying drawings schematically illustrates a typical surface conduction electron-emitting device proposed by M. Hartwell. In FIG. 13, reference numeral 31 denotes a substrate. Reference numeral 34 denotes an electroconductive thin film normally prepared by producing an H-shaped thin metal oxide film by means of sputtering, part of which eventually makes an electron-emitting region 35 when it is subjected to a current conduction process referred to as "energization forming" as described hereinafter. Note that the electron-emitting region 35 is shown only schematically because there is no knowing its position and profile.

Conventionally, an electron-emitting region 35 is produced in a surface conduction electron-emitting device by subjecting the electroconductive thin film 34 of the device to a preliminary current conduction process, which is referred to as "energization forming". In the energization forming process, a constant DC voltage or a slowly rising DC voltage that rises typically at a rate of 1V/min. is applied to the opposite ends of the electroconductive thin film 34 to partly destroy, deform or transform the film and produce an electron-emitting region 35 which is electrically highly resistive.

Thus, the electron-emitting region 35 is part of the electroconductive thin film 34 that typically contains a fissure or fissures therein so that electrons may be emitted from there. Note that, once subjected to an energization forming process, a surface conduction electron-emitting device comes to emit electrons from its electron-emitting region 35 whenever an appropriate voltage is applied to the electroconductive thin film 34 to make an electric current run through the device.

Since a surface conduction electron-emitting device has a particularly simple structure and can be manufactured in a simple manner, a large number of such devices can advantageously be arranged on a large area without difficulty. As a matter of fact, a number of studies have been made to fully exploit this advantage of surface conduction electron-emitting devices. For example, there have been proposed various types of image-forming apparatus including an emission type flat image-forming apparatus.

In a typical example of electron source comprising a large number of surface conduction electron-emitting devices, the devices may be arranged in parallel rows and the positive (higher potential side) and negative (lower potential side) electrodes of the devices of each row may be connected to respective common wirings. (See, for example, Japanese Patent Application Laid-Open No. 1-31332 filed by the applicant of the present patent application.)

Various types of image-forming apparatus including image displays can be realized by combining an electron source comprising a large number of surface conduction electron-emitting devices and an image-forming member that emits visible light when hit by electrons coming from the electron source. (See, for example, U.S.

Pat. No. 5,066,883 of the applicant of the present patent application.) Since high quality emission type image-forming apparatuses having a large display screen can be prepared relatively easily by using surface conduction electron-emitting devices, such apparatuses are expected to largely replace CRTs in the near future.

For instance, an image-forming apparatus disclosed in Japanese Patent Application Laid-Open No. 2-257551 filed by the applicant of the present patent application comprises an electron source formed by a large number of surface conduction electron-emitting devices arranged in rows, each of which can be selected by applying an appropriate drive signal to a selected pair of the wires arranged in parallel with the rows of surface conduction electron-emitting devices (row-directional wires) and a selected one of the wires (column-directional wires) connected to control electrodes arranged perpendicular to the row-directional wires and disposed in a space between the electron source and a fluorescent body.

However, it has been found that conventional types of electroconductive frit and an image-forming apparatus using such electroconductive frit can be accompanied by the following problems.

In a series of intensive research efforts, the inventors of the present invention prepared an image-forming apparatus by using a type of electroconductive frit produced by combining powdery metal and powdery glass having a low melting point, said apparatus comprising at least a face plate having a fluorescent body and an electron accelerating electrode, an electron source substrate disposed vis-a-vis the face plate and having an electron source and electroconductive spacers disposed between the electron accelerating electrode and the electron source. As a result, it was found that the spacers could be mechanically secured and electrically connected to the electron accelerating electrode and the electron source in a satisfactory manner only when the operation of mechanically securing and electrically connecting the spacers to the electron accelerating electrode and the electron source was conducted in a rigorously controlled manner with an enhanced level of craftsmanship.

More specifically, if the ratio of the powdery glass relative to the powdery metal in the electroconductive frit was raised to achieve a satisfactory level of mechanical strength to secure the spacers in position, it did not provide a satisfactory level of electric connectability so that the spacers could be electrically charged to modify the electric field existing there and consequently displace the trajectories of electrons after a long time of use for displaying images. Then, consequently, the fluorescent body could change the positions and the contour of its fluorescing spots. If, to the contrary, the ratio of the powdery metal relative to the powdery glass in the electroconductive frit was raised to achieve a satisfactory level of electric connectability, the thermal expansion coefficient of the electroconductive frit increased and consequently a large difference was produced between the thermal expansion coefficient of the glass-based spacers and that of the electroconductive frit and became particularly remarkable at areas they were put together, leading to damaged spacers and other components of the image-forming apparatus. The net result was an envelope that could not withstand the atmospheric pressure.

SUMMARY OF THE INVENTION

In view of the above problems, it is therefore an object of the present invention to provide a specific type of electroconductive frit (in the form of a powdery, pasty or baked material) and an image-forming apparatus realized by using such electroconductive frit.

Another object of the present invention is to provide an image-forming apparatus that can effectively minimize the change in the positions and the contour of its fluorescing spots.

According to a first aspect of the invention, the above technological problems can be dissolved and the objects of the invention can be achieved by providing electroconductive frit characterized in that it comprises glass having a low melting point and a filler of fine glass particles coated on the surface with metal.

According to a second aspect of the invention, there is also provided electroconductive frit characterized in that it comprises glass having a low melting point, a filler of fine glass particles coated on the surface with metal and a low-expansion ceramic filler.

According to a third aspect of the invention, there is also provided an image-forming apparatus comprising a face plate having a fluorescent body and an electron accelerating electrode, an electron source substrate disposed vis-a-vis the face plate and having an electron source and an electroconductive spacer disposed between the electron accelerating electrode and/or a wire of the electron source, characterized in that said electroconductive spacer is secured and electrically connected to the electron accelerating electrode and the electron source by means of electroconductive frit according to the first or second aspect of the invention.

The technological problems as identified earlier are dissolved with the above arrangement.

More specifically, a type of electroconductive frit according to the invention and comprising glass having a low melting point and a filler of fine glass particles coated on the surface with metal can satisfactorily meet the requirement of mechanically securing strength and that of electric connectability.

With such a type of electroconductive frit, if the ratio of fine glass particles coated on the surface with metal relative to glass is raised in order to achieve a satisfactory level of electric connectability, only the metal on the surface of the particles contributes to a possible increase of the thermal expansion coefficient of frit glass to suppress any remarkable rise in the overall thermal expansion coefficient of frit glass and obtain sufficient securing strength at the bonding portions if compared with a case where the ratio of powdery metal is increased. In short, electroconductive frit according to the invention can meet the requirement of mechanically securing strength and that of electric connectability at the same time. Thus, an image-forming apparatus according to the invention is free from the above identified problems of conventional image-forming apparatuses.

Additionally, an image-forming apparatus according to the invention can effectively minimize the change in the positions and the contour of its fluorescing spots and, at the same time, has satisfactory mechanically securing strength and electric connectability.

DESCRIPTION OF THE PREFERRED EMBODIMENTS

Electroconductive frit and an image-forming apparatus according to the invention respectively have a composition and a configuration as described above.

Figure 18:
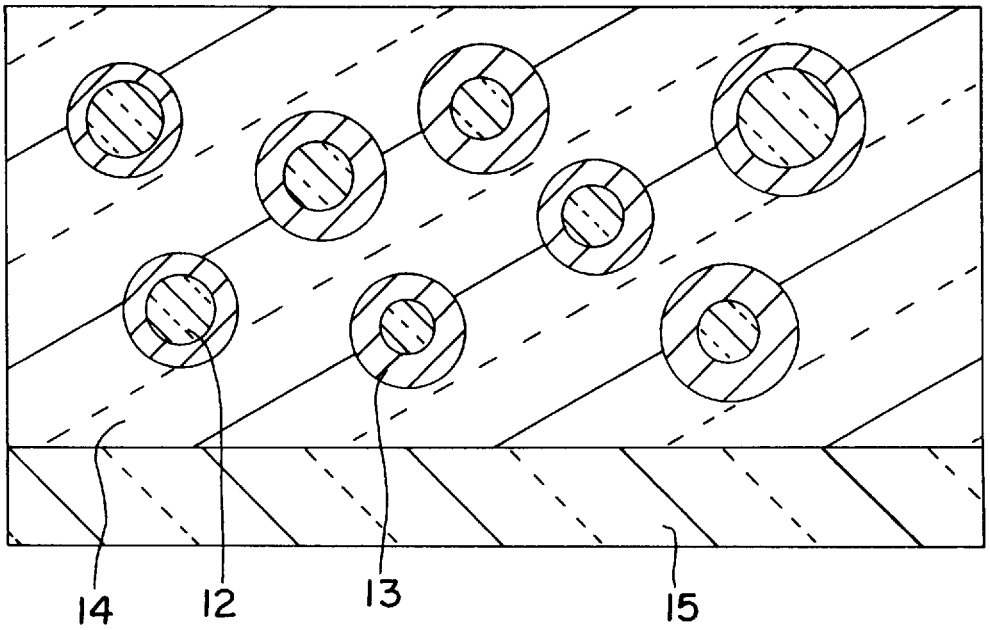
FIG. 18 is a schematic cross sectional view of an electroconductive frit according to the invention.

Electroconductive frit according to the invention as shown in Fig. 18 and comprising an electroconductive filler of fine glass particles 12 coated on the surface with metal low melting point glass 14 on a glass substrate 15 does not show a remarkable increase of the thermal expansion coefficient when compared with an electroconductive filler of fine metal particles.

The thermal expansion coefficient of granulatable metal such as Ag, Al, Au, Fe, Cu, Ni or Pb is generally greater than $120\times10^{-7}$°$C^{-1}$ and much greater than that of a filler of fine glass particles whose thermal expansion coefficient is generally smaller than $90\times10^{-7}$°$C^{-1}$. Therefore, the thermal expansion coefficient of frit rises as the content of the particulate metal filler remarkably increases if compared with frit containing a particulate glass filler. In view of this fact, electroconductive frit according to the invention comprises an electroconductive filler of fine glass particles coated on the surface with metal that is required for securing a certain level of electric conductivity, whereas glass having a relatively small thermal expansion coefficient is used for the base members of the filler so that the electroconductive frit does not show a remarkable increase in the thermal expansion coefficient if the content of the filler is raised.

For the purpose of the present invention, the base members of the electroconductive filler of electroconductive frit according to the invention are preferably spherical particles of soda lime glass or silica. The spherical base members preferably have an average diameter substantially equal to that of spherical glass particles that are mixed with the electroconductive filler and have a relatively low melting point. Preferably, their diameters do not show a large deviation from the average value. The maximum diameter of the base members is preferably same as that of the spherical glass particles that are mixed with them. If the electroconductive frit is applied to small objects (with a size less than 1 mm), they preferably have a diameter less than a half of the size.

Electroconductive frit according to the present invention is prepared by forming a metal film on the surface of the base members typically by plating. An undercoating layer may be used in order to provide a good adhesion between the base member and the surface metal layer. The metal to be used for the surface metal film is typically selected from Cu, Cr, Ni, Au, Ag and Pt, although the use of Au, Ag or Pt is preferable because these metals are substantially free from oxidation. The film thickness if between 0.005 and 1 $\mu$m, preferably between 0.02 and 0.1 $\mu$m. If the film thickness exceeds 1 $\mu$m, the difference of the thermal expansion coefficients of the two components increases to give rise to a cracked surface. Since the metal is coated only on the surface of the base members, the filler can be provided at remarkably reduced cost if compared with the use of a filler of powdery gold.

In electroconductive frit according to the invention, an electroconductive filler is preferably added to the low melting point glass by 3 to 95% by weight. If the ratio is smaller than 3%, the electroconductive frit totally loses its volume resistivity. It shows a volume resistivity between $10^{-5}$ and $10^{4}$ Ωcm and a strong adhesion relative to soda lime glass.

The content of the electroconductive filler is more preferably between 10 and 25% by weight. If the content is found within these values, the electroconductive frit stably shows a volume resistivity between $10^{-3}$ and $10^{10}$ Ωcm and a stronger adhesion relative to soda lime glass. If, on the other hand, the content exceeds 40% by weight, its volume resistivity falls somewhere between $10^{-5}$ and 1 Ωcm and the adhesion relative to soda lime glass is weakened. In short, if the content of the electroconductive filler is low, the electric resitivity of the frit rises but the adhesion of the frit relative to soda lime glass increases. To the contrary, if the content of the electroconductive filler is high the electric resistivity of the frit falls but the adhesion of the frit relative to soda lime glass is weakened.

In case of bonding a material having a different thermal expansion coefficient from the electroconductive frit of the present invention by using the electroconductive frit of the present invention, lowly expansive ceramic fillers may preferably be added at a mixed content of 0 to 25% to the electroconductive frit of the present invention so that the mixture has the same thermal expansion coefficient as the material to the bonded.

Lowly expansive ceramic fillers that can be used for the purpose of the invention preferably have a thermal expansion coefficient less than $70\times10^{-7}$°$C^{-1}$ and contain at least one of zircon, lead titanate, aluminum titanate, alumina, mullite, cordierite, β-eucryptite and β-spodumene. However, if the content exceeds 25% by weight, the mechanically securing strength decreases.

The lowly expansive ceramic fillers to be used for the purpose of the invention preferably have an average particle diameter and a maximum particle diameter smaller than their counterparts of the electroconductive filler.

The prepared powdery electroconductive frit is made pasty if it is preferable to obtain a good applicability for the frit. Pasty frit can be prepared by mixing the powdery electroconductive frit with a vehicle obtained by dissolving a binding agent into solvent. The binding agent may be acrylic synthetic resins and the solvents may be organic solvent such as alcohol or ether.

The powdery or pasty electroconductive frit can provide a desired level of mechanically securing strength and that of electric connectability when it is baked. If necessary, a preliminary baking step may be used in order to preliminarily decompose and burn the organic binder contained in the pasty electroconductive frit.

Electroconductive frit according to the present invention can be applied by means of a dispenser. It may be applied accurately and finely if the glass having a low melting point and the filler have an average particle diameter between 5 and 50 $\mu$m.

Now, an image-forming apparatus realized by using electroconductive frit according to the invention will be described. Firstly, an electron source that can be used for the purpose of the invention will be illustrated. Surface conduction electron-emitting devices that have a simple configuration and can be manufactured in a simple manner are preferably used for the cold cathode electron source of an image-forming apparatus according to the invention.

Figure 1A:
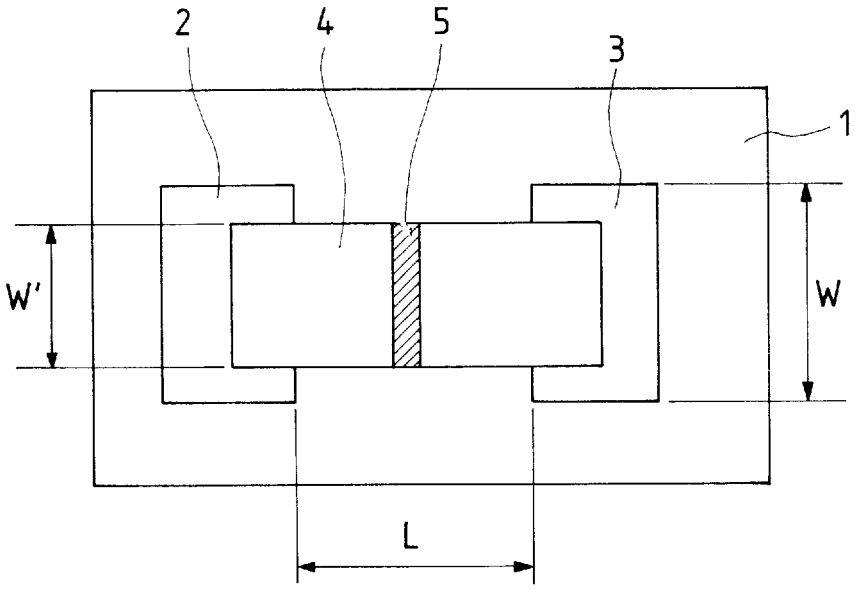
FIGS. 1A and 1B are a schematic plan view and a schematic cross sectional view of a surface conduction electron-emitting device.
Figure 1B:
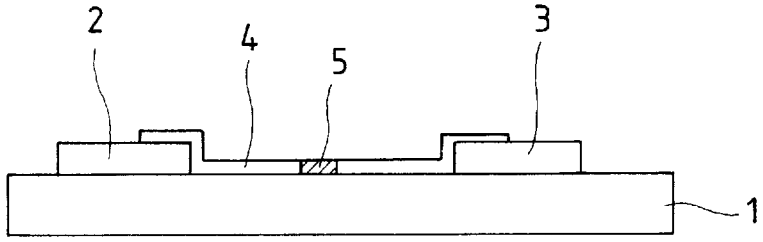

Surface conduction electron-emitting devices that can be used for the purpose of the present invention may be either of a flat type or of a step type. FIGS. 1A and 1B are a schematic plan view and a schematic cross sectional view of a surface conduction electron-emitting device.

Referring to FIGS. 1A and 1B., the device comprises a substrate 1, a pair of device electrodes 2 and 3, an electroconductive thin film 4 and an electron-emitting region 5.

The substrate 1 is typically made of soda lime glass or a glass substrate realized by forming an $SiO_2$ layer on soda lime glass.

While the oppositely arranged device electrodes 2 and 3 may be made of any highly conducting material, preferred candidate materials include metals such as Ni, Cr, Au, Mo, W, Pt, Ti, Al, Cu and Pd and their alloys, printable conducting materials made of a metal or a metal oxide such as Pd, Ag, $RuO_2$ and Pd-Ag together with glass or the like, transparent conducting materials such as $In_2O_3$-$SnO_2$ and semiconductor materials such as polysilicon.

The distance L separating the device electrodes 2 and 3 is preferably between hundreds of several angstroms and hundreds of several micrometers. The voltage to be applied between the device electrodes is preferably as low as possible. In view of reproducibility, the distance separating the device electrodes is most preferably between several micrometers and hundreds of several micrometers.

The length W of the device electrodes 2 and 3 is preferably between several micrometers and hundreds of several micrometers depending on the resistance of the electrodes and the electron-emitting characteristics of the device. The film thickness d of the device electrodes 2 and 3 is between hundres of several nanometers and several micrometers.

Note that, unlike the configuration of FIGS. 1A and 1B, a surface conduction electron-emitting device may alternatively be prepared by sequentially forming an electroconductive thin film 4 and device electrodes 2 and 3 on a substrate 1.

The electroconductive thin film 4 is preferably a fine particle film in order to provide excellent electron-emitting characteristics. The thickness of the electroconductive thin film 4 is determined as a function of the stepped coverage of the electroconductive thin film on the device electrodes 2 and 3, the electric resistance between the device electrodes 2 and 3 and the parameters selected for the energization forming operation that will be described later as well as other factors and preferably between a several angstroms and thousands of several angstroms and more preferably between ten angstroms and five hundred angstroms. The electroconductive thin film 4 normally shows a sheet resistance between $10^3$ and $10^7\Omega\square$.

The electroconductive thin film 4 is made of fine particles of a material selected from metals such as Pd, Pt,Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$. $YB_4$ and $GdB_4$, carbides such TiC, ZrC, HfC, TaC, SiC and WC, nitrides such as TiN, ZrN and HfN, semiconductors such as Si and Ge and carbon.

The term a "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between several angstroms and thousands of several angstroms and preferably between ten angstroms and two hundred angstroms.

The electron-emitting region 5 is a fissure or fissures formed in part of the electroconductive thin film 4 and produced typically as a result of energization forming. It may have electroconductive fine particles having a diameter between several angstroms and hundreds of several angstroms within the fissure. Such electroconductive fine particles may contain part or all of the materials that are used to prepare the thin film 4.

The electron-emitting region 5 and part of the electroconductive thin film 4 located close to the electron-emitting region 5 may contain carbon and one or more than one carbon compounds.

Figure 2:
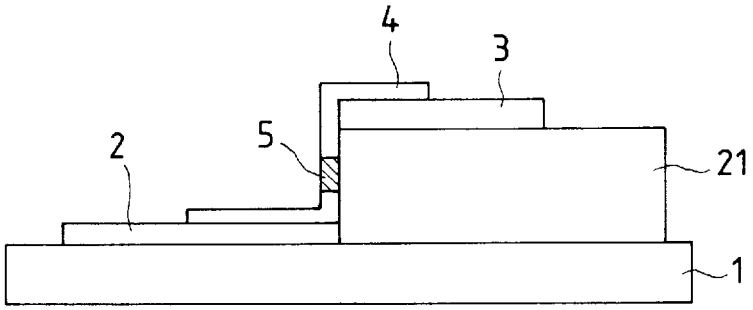
FIG. 2 is a schematic cross sectional view of a step type surface conduction electron-emitting device.

FIG. 2 is a schematic sectional side view of a step type surface conduction electron emitting device.

In FIG. 2, those components that are same or similar to those of FIGS. 1A and 1B are denoted respectively by the same reference symbols. Reference symbol 21 denotes a step-forming section.

The device comprises a substrate 1, a pair of device electrodes 2 and 3, an electroconductive thin film 4 and an electron-emitting region 5, which may be made of materials same as those of a flat type surface conduction electron-emitting device as described above, as well as a step-forming section 21 made of an insulating material. The step-forming section 21 has a film thickness that operates as the distance L separating the device electrodes of a flat type surface conduction electron-emitting device as described above and is between hundreds of several angstroms and tens of several micrometers. Preferably, the film thickness of the step-forming section 21 is between hundreds of several angstroms and several micrometers depending on the method of forming a step-forming section and should be controlled by the voltage to be applied to between the device electrodes.

As the electroconductive thin film 4 is formed after the device electrodes 2 and 3 and the step-forming section 21, it may preferably be laid on the device electrodes 2 and 3. While the electron-emitting region 5 looks linearly formed in the step-forming section 21 in FIG. 2, its location and contour are dependent on the conditions under which it is prepared, the energization forming conditions and other related conditions and not limited to those shown there.

Figure 3A:
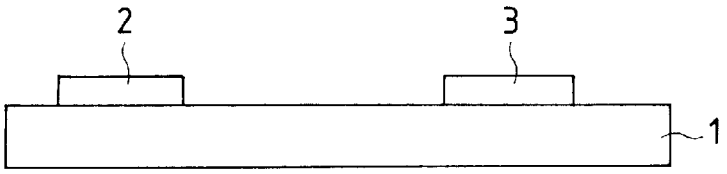
FIGS. 3A through 3C are schematic cross sectional views of a surface conduction electron-emitting device in different manufacturing steps.
Figure 3B:
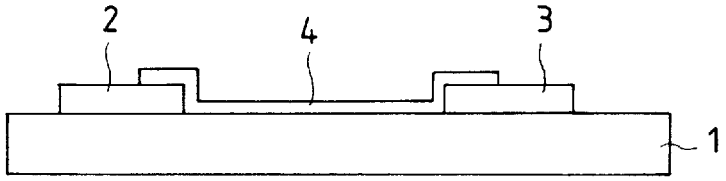
Figure 3C:
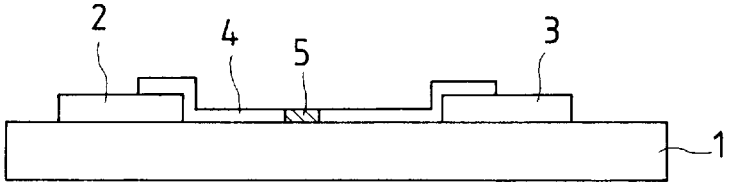

Now, a method of manufacturing an electron source substrate will be described by referring to FIGS. 1A and 1B and 3A through 3C. In FIGS. 3A through 3C, the components that are same or similar to those of FIGS. 1A and 1B are denoted respectively by the same reference symbols.

(1) After thoroughly cleansing a substrate 1 with detergent and pure water, a material is deposited on the substrate 1 by means of vacuum evaporation, sputtering or some other appropriate technique for a pair of device electrodes 2 and 3, which are then produced by photolithography (FIG. 3A).

(2) An organic metal thin film is formed on the substrate I carrying thereon the pair of device electrodes 2 and 3 by applying an organic metal solution and leaving the applied solution for a given period of time. The organic metal solution contains as a principal ingredient an organic metal compound of the metal that constitutes the electroconductive thin film 4 as described above. Thereafter, the organic metal thin film is heated, baked and subsequently subjected to a patterning operation, using an appropriate technique such as lift-off or etching, to produce an electroconductive thin film 4 (FIG. 3B).

While an organic metal solution is used to produce a thin film in the above description, an electroconductive thin film 4 may alternatively be formed by vacuum evaporation, sputtering, chemical vapor deposition, dispersion coating, dipping, spinner coating or some other technique.

(3) Thereafter, the device electrodes 2 and 3 are subjected to a current conduction process referred to as "energization forming". More specifically, the device electrodes 2 and 3 are electrically energized by means of a power source (not shown) until the electroconductive thin film 4 is locally destroyed, deformed or transformed to show a structurally modified region, which is referred to as an electron-emitting region (FIG. 3C).

Figure 4A:
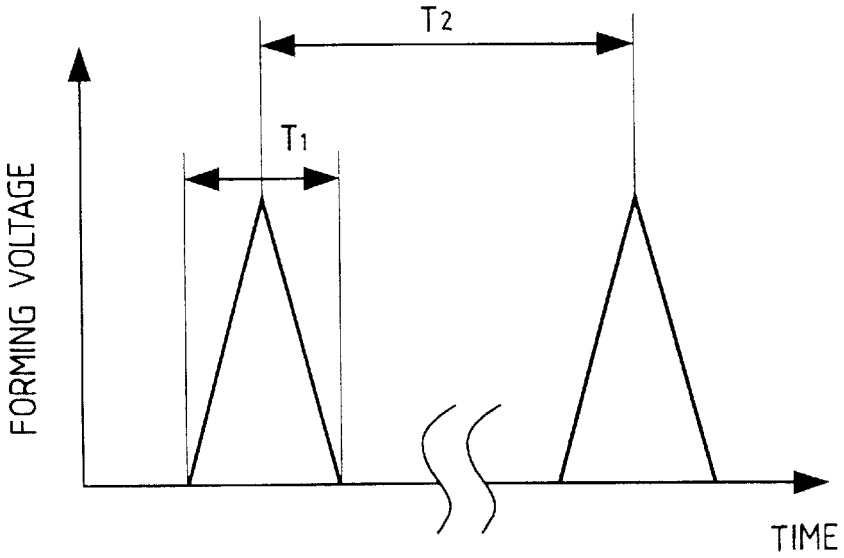
FIGS. 4A and 4B are graphs showing voltage waveforms that can be used for energization forming for the purpose of the present invention.
Figure 4B:
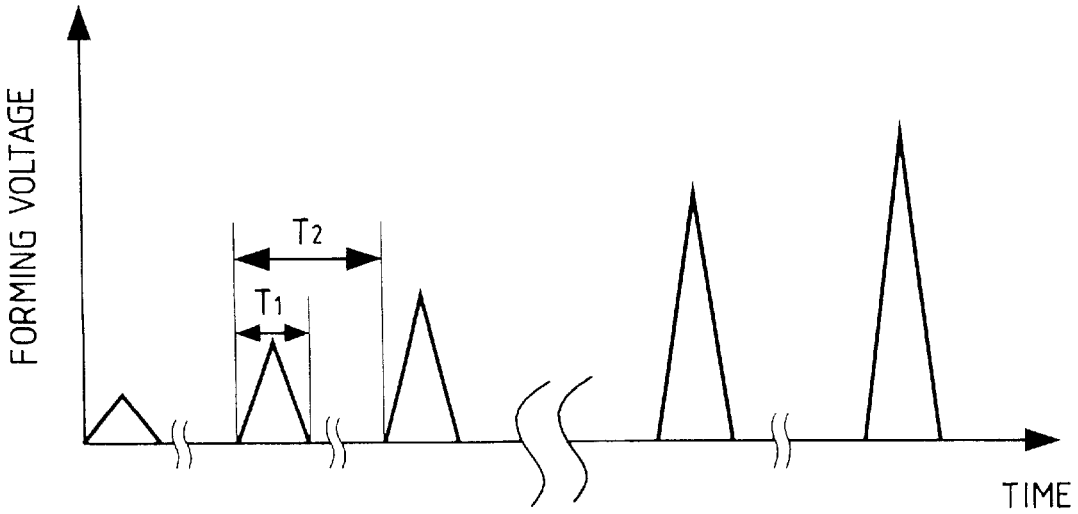

FIGS. 4A and 4B show two different pulse voltages that can be used for energization forming.

The voltage to be used for energization forming preferably has a pulse waveform. A pulse voltage having a constant wave height or a constant peak voltage may be applied continuously (as shown in FIG. 4A) or, alternatively, a pulse voltage having an increasing wave height or an increasing peak voltage may be applied (as shown in FIG. 4B).

Firstly, a pulse voltage having a constant wave height will be described (FIG. 4A).

In FIG. 4A, the pulse voltage has a pulse width Ti and a pulse interval T2, which are typically between 1 $\mu$sec. and 10 msec. and between 10 $\mu$sec. and 100 msec. respectively. The height of the triangular wave (the peak voltage for the energization forming operation) may be appropriately selected depending on the profile of the surface conduction electron-emitting device. The voltage is typically applied for a period of time between several seconds and tens of several minutes in vacuum of an appropriate degree, typically $10^{-5}$ torr. Note, however, that the pulse waveform is not limited to triangular and a rectangular or some other waveform may alternatively be used.

FIG. 4B shows a pulse voltage whose pulse height increases with time. In FIG. 4B, the pulse voltage has an width Ti and a pulse interval T2 that are substantially similar to those of FIG. 4A. The height of the triangular wave (the peak voltage for the energization forming operation) is increased at a rate of, for instance, 0.1V per step.

The energization forming operation will be terminated by measuring the current running through the device electrodes when a voltage that is sufficiently low and cannot locally destroy or deform the electroconductive thin film 4 is applied to the device during an interval T2 of the pulse voltage. Typically the energization forming operation is terminated when a resistance greater than 1 M ohms is observed for the device current running through the electroconductive thin film 4 while applying a voltage of approximately 0.1V to the device electrodes.

(4) After the energization forming operation, the device is preferably subjected to an activation process.

In an activation process, a pulse voltage having a constant wave height is repeatedly applied to the device in a vacuum atmosphere in vacuum of a degree between $10^{-4}$ torr and $10^{-5}$ torr, as in the energization forming operation. In this process, carbon or a carbon compound contained in the organic substances existing in vacuum at a very minute concentration is deposited on the electroconductive thin film to give rise to a remarkable change in the device current If and the emission current Ie of the device.

The activation process is conducted while observing the device current If and the emission current Ie, and terminated when the emission current Ie gets to a saturated level. The pulse voltage to be applied to the device in this process is preferably equal to the voltage to be used to drive the device in actual operation.

Carbon or a carbon compound as used herein refers to graphite (including both mono- and poly-crystalline graphite) or amorphous carbon (or a mixture of amorphous carbon and polycrystalline carbon) and the film thickness of such a substance to be used for the purpose of the present invention is preferably less than 500 angstroms, preferably less than 300 angstroms.

(5) An electron-emitting device that has been treated in an energization forming process and an activation process is then preferably driven to operate in vacuum of a degree higher than the degree involved in the energization forming and the activation. Preferably, the device is heated in vacuum of a still higher degree at 80° C. to 150° C. before it is driven to operate.

Vacuum of a degree higher than the degree involved in the energization forming process and the activation process specifically refers to vacuum of $10^{-6}$ torr or higher degree, at which no additional carbon or one or more than one carbon compounds would deposit on the electroconductive thin film. With such a treatment, the device current If and the emission current Ie of the device can be stabilized.

The performance of a surface conduction electron-emitting device prepared by way of the above processes, to which the present invention is applicable, will be described by referring to FIGS. 5 and 6.

Figure 5:
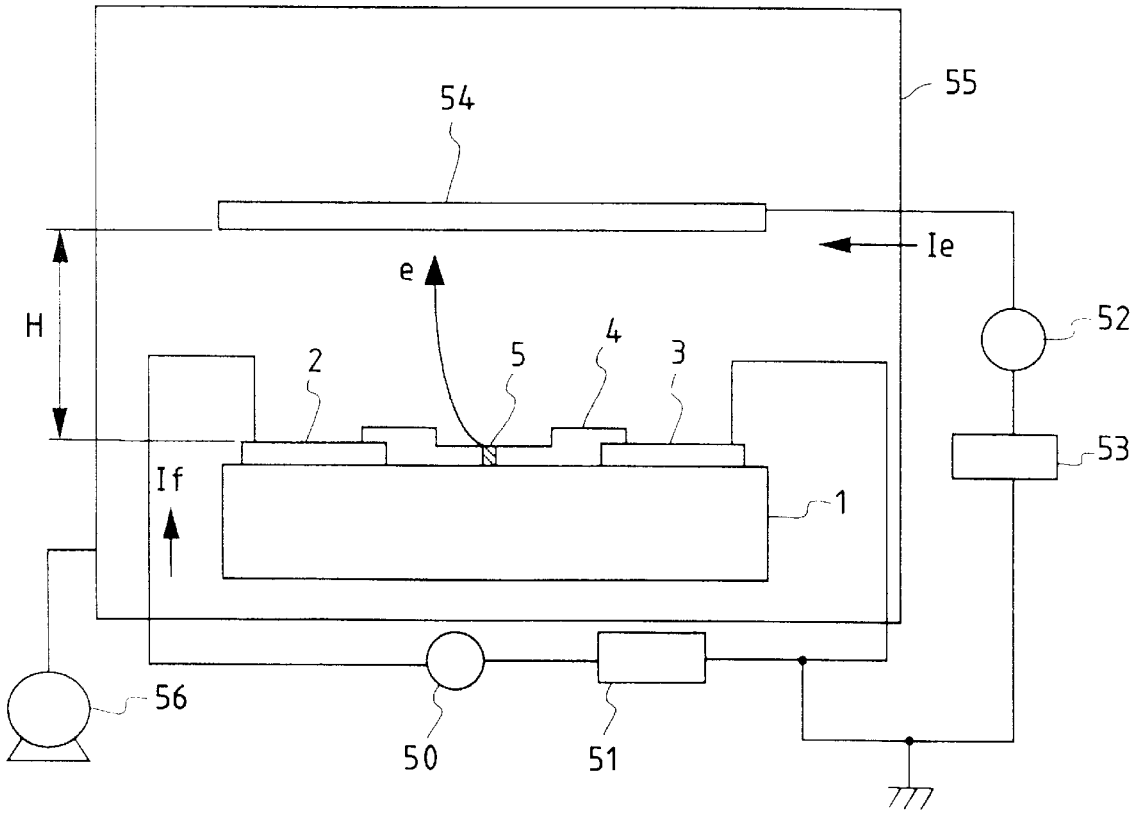
FIG. 5 is a schematic diagram of a gauging system for determining the electron-emitting performance of an electron-emitting device for the purpose of the present invention.

FIG. 5 is a schematic block diagram of an arrangement comprising a vacuum chamber that can be used for the above processes. It can also be used as a gauging system for determining the performance of an electron emitting device of the type under consideration. In FIG. 5, the components of a surface conduction electron-emitting device are denoted by the reference symbols same as those of FIGS. 1A and 1B. Referring to FIG. 5, the gauging system includes a vacuum chamber 55 and a vacuum pump 56. An electron-emitting device is placed in the vacuum chamber 55. The device comprises a substrate 1, a pair of device electrodes 2 and 3, a thin film 4 and an electron-emitting region 5. Otherwise, the gauging system has a power source 51 for applying a device voltage Vf to the device, an ammeter 50 for metering the device current If running through the thin film 4 between the device electrodes 2 and 3, an anode (electron accelerating electrode) 54 for capturing the emission current Ie produced by electrons emitted from the electron-emitting region of the device, a high voltage source 53 for applying a voltage to the anode 54 of the gauging system and another ammeter 52 for metering the emission current Ie produced by electrons emitted from the electron-emitting region 5 of the device. For determining the performance of the electron-emitting device, a voltage between 1 and 10 KV may be applied to the anode, which is spaced apart from the electron emitting device by distance H which is between 2 and 8 mm.

Instruments including a vacuum gauge (not shown) and other pieces of equipment necessary for the gauging system are arranged in the vacuum chamber 55 so that the performance of the electron-emitting device or the electron source in the chamber may be properly tested. The vacuum pump 56 is provided with an ordinary high vacuum system comprising a turbo pump or a rotary pump and an ultra-high vacuum system comprising an ion pump. The vacuum chamber containing an electron source therein can be heated to 200° C. by means of a heater (not shown). Thus, all the processes from the energization forming process on can be carried out with this arrangement.

Figure 6:
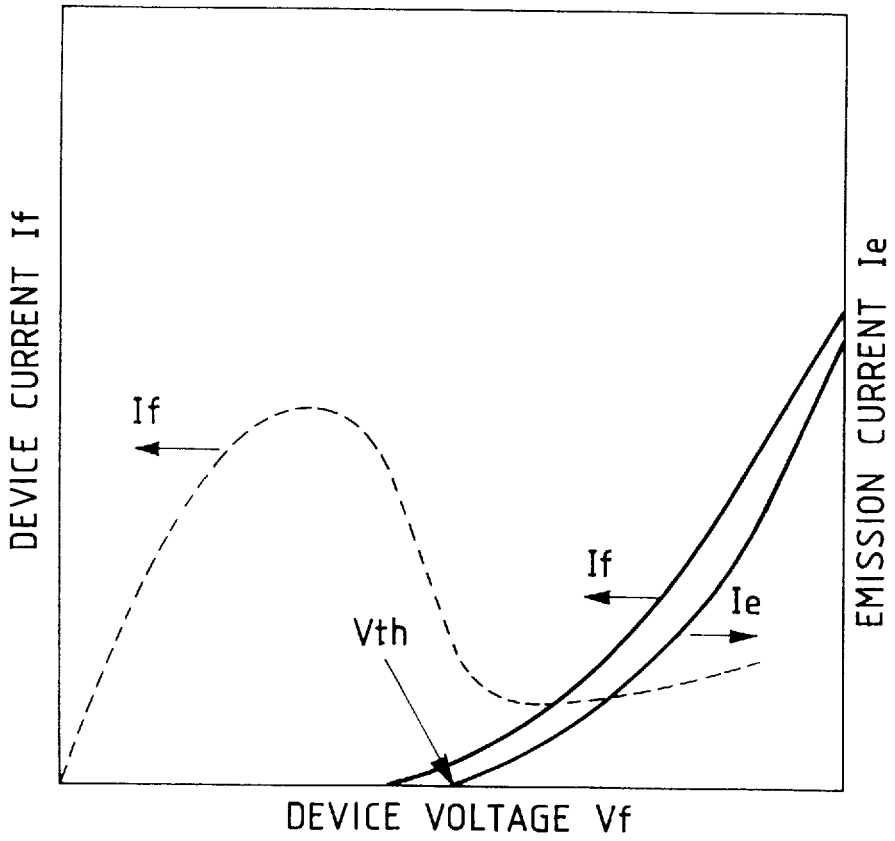
FIG. 6 is a graph showing the typical electron-emitting performance of an electron-emitting device.

FIG. 6 shows a graph schematically illustrating the relationship between the device voltage Vf and the emission current Ie and the device current If typically observed by the gauging system of FIG. 5. Note that different units are arbitrarily selected for Ie and If in FIG. 6 in view of the fact that Ie has a magnitude by far smaller than that of If. As seen in FIG. 6, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 7), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is highly dependent (as a monotonically increasing function) on the device voltage Vf, the former can be effectively controlled by way of the latter.

(iii) Thirdly, the emitted electric charge captured by the anode 54 is a function of the duration of time of application of the device voltage Vf. In other words, the amount of electric charge captured by the anode 54 can be effectively controlled by way of the time during which the device voltage Vf is applied.

Because of the above remarkable features, it will be understood that the electron-emitting behavior of an electron source comprising a plurality of electron-emitting devices according to the invention and hence that of an image-forming apparatus incorporating such an electron source can easily be controlled in response to the input signal. Thus, such an electron source and an image-forming apparatus may find a variety of applications.

Now, an image-forming apparatus according to the invention will be described.

An electron source substrate to be comprised in an image-forming apparatus is prepared by arranging a plurality of surface conduction electron-emitting devices on a substrate.

Electron-emitting devices may be arranged on a substrate in a number of different ways. For instance, a number of surface conduction electron-emitting devices may be arranged in parallel rows along a direction, each device being connected by wires at opposite ends thereof, (hereinafter referred to as a ladder-type electron source substrate), or in a simple matrix arrangement, where the paired electrodes of each of a number of surface conduction electron-emitting devices may be respectively connected to one of the X-directional wires and one of the Y-directional wires of the electron source (hereinafter referred to as a matrix type electron source substrate).

An image-forming apparatus comprising a ladder-type electron source substrate is required to have control electrodes (grid electrodes) for controlling the flight of electrons emitted from the surface conduction electron-emitting devices. An electron source having a simple matrix configuration will be described by referring to FIG. 7. In FIG. 7, the electron source comprises an electron source substrate 71, X-directional wires 72, Y-directional wires 73, surface conduction electron-emitting devices 74 and connecting wires 75. The surface conduction electron-emitting devices 74 may be either of the flat type or of the step type described earlier.

Figure 7:
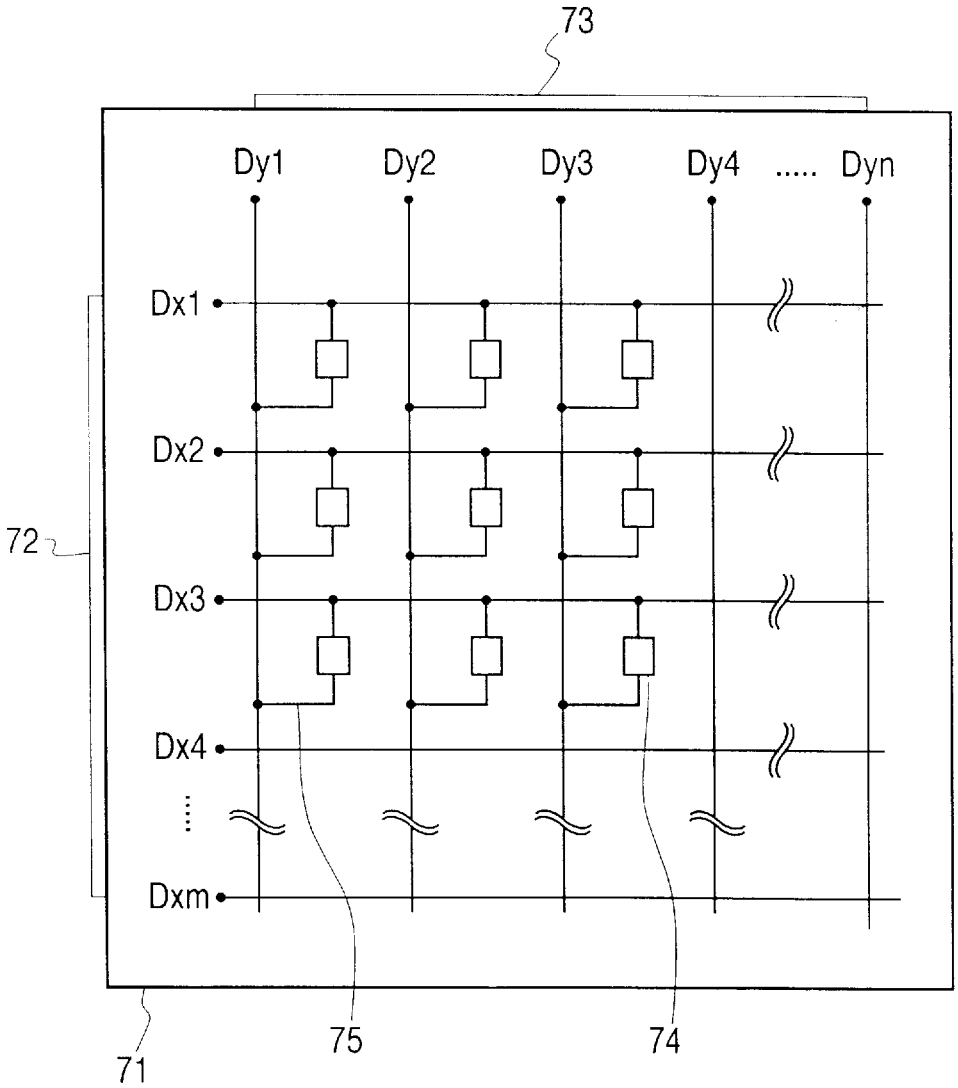
FIG. 7 is a schematic plan view of an electron source having a simple matrix arrangement.

In FIG. 7, the electron source substrate 71 may be a glass substrate as described earlier having an appropriate profile optimally selected for a specific application.

There are provided a total of m X-directional wires 22, which are donated by Dx1, Dx2, . . . , Dxm and a total of n Y-directional wires, which are donated by Dy1, Dy2, . . . , Dyn.

The material, the thickness and the width of these wires are selected appropriately such that an equal voltage may be applied to the surface conduction electron-emitting devices. An interlayer insulation layer (not shown) is disposed between the m X-directional wires and the n Y-directional wires to electrically isolate them from each other. (Both m and n are integers.)

The interlayer insulation layer (not shown) is typically formed on the entire surface or part of the surface of the insulating substrate 71 that carries thereon the X-directional wires 72. Each of the X-directional wires 72 and the Y-directional wires 73 is drawn out to form an external terminal.

The oppositely arranged electrodes (not shown) of each of the surface conduction electron-emitting devices 74 are connected to related one of the m X-directional wires 72 and related one of the n Y-directional wires 73 by respective connecting wires 75.

The surface conduction electron-emitting devices may be formed either on the substrate or on the interlayer insulation layer (not shown).

As will be described in greater detail hereinafter, the X-directional wires 72 are electrically connected to a scan signal generation means (not shown) for applying a signal to a selected row of surface conduction electron-emitting devices 74 according to an input signal. On the other hand, the Y-directional wires 73 are electrically connected to a modulation signal generation means (not shown) for applying a modulation signal to a selected column of surface conduction electron-emitting devices 74 and modulating the selected column according to an input signal.

Note that the drive voltage to be applied to each surface conduction electron-emitting device is expressed as the voltage difference of the scan signal and the modulation signal applied to the device.

With the above arrangement, each of the devices can be selected and driven to operate independently by means of a simple matrix wire arrangement.

Now, an image-forming apparatus comprising an electron source having a simple matrix arrangement as described above will be described by referring to FIG. 8 through 10.

Figure 8:
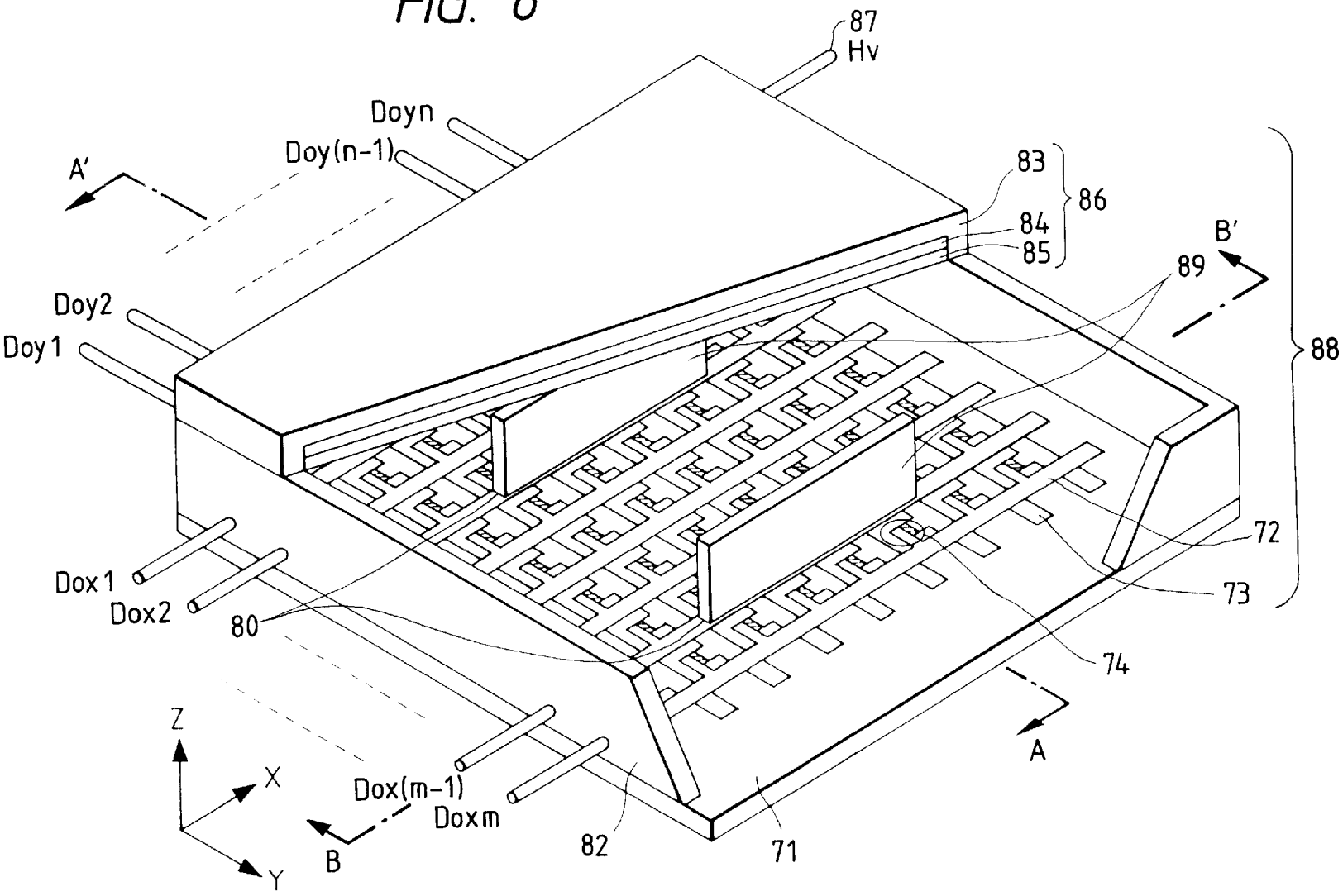
FIG. 8 is a schematic perspective view of an image-forming apparatus.
Figure 9A:
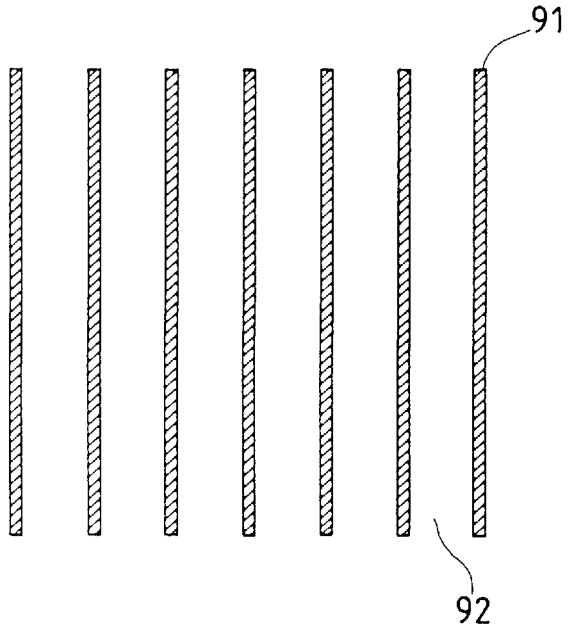
FIGS. 9A and 9B are two possible arrangements of fluorescent members that can be used for the purpose of the present invention.
Figure 9B:
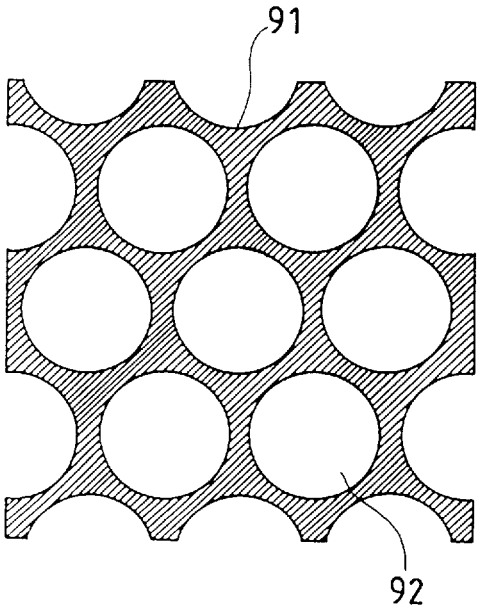
Figure 10:
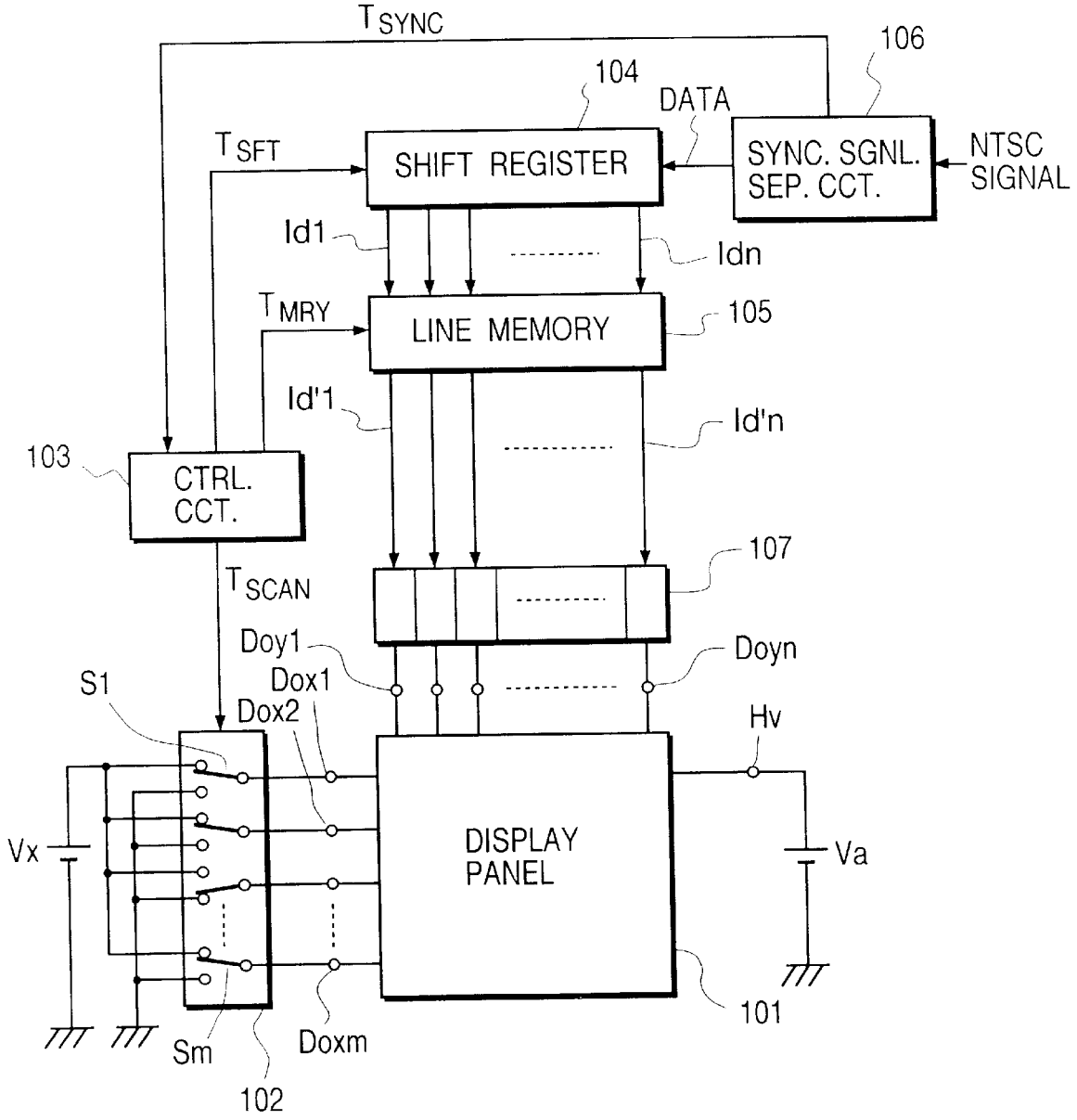
FIG. 10 is a block diagram of an image-forming apparatus showing a schematic circuit diagram of a drive circuit that can be used for displaying images according to NTSC television signals.

FIG. 8 is a partially cut away schematic perspective view of the image-forming apparatus and FIGS. 9A and 9B are schematic views, illustrating two possible configurations of a fluorescent film that can be used for the image forming apparatus, whereas FIG. 10 is a block diagram of a drive circuit for the image forming apparatus that operates for NTSC television signals.

Referring firstly to FIG. 8 illustrating the basic configuration of the display panel of the image-forming apparatus, it comprises an electron source substrate 71 of the above described type carrying thereon a plurality of electron-emitting devices, a face plate 86 prepared by laying a fluorescent film 84 and a metal back (electron accelerating electrode) 85 on the inner surface of a soda lime glass substrate 83, a support frame 82 and electroconductive spacers 89 prepared by forming an electroconductive film of a substance such as $SnO_2$ on thin soda lime glass substrates. These components are hermetically sealed to form an envelope 88. Ordinary insulating frit is used for bonding the electron source substrate 71, the face plate 86 and the support frame 82, whereas electroconductive frit 80 according to the invention is used to bond the electron source (wires) of the electron source substrate and the electron accelerating electrode and the electroconductive spacers 89 of the face plate. For the purpose of the present invention, an ordinary frit means a powdery inorganic adhesive agent containing glass having a low melting point as a principal ingredient, to which a powdery ceramic filler is added to regulate the thermal expansion coefficient in order to prevent cracks from taking place due to a large difference between the thermal expansion coefficients of the frit and that of the object to which the frit is applied.

In FIG. 8, reference numeral 74 denotes an area that corresponds to an electron-emitting region as shown in FIGS. 1A and 1B. Reference numerals 72 and 73 respectively denote an X-directional wire and a Y-directional wire connected to the paired electrodes of a surface conduction electron-emitting device.

FIGS. 9A and 9B schematically illustrate two possible arrangements of a fluorescent body 92 that can be used for the purpose of the invention. While the fluorescent body 92 comprises only a single fluorescent member if the display panel is used for showing black and white pictures, it needs to comprise for displaying color pictures black conductive members 91 and fluorescent members 92, of which the former are referred to as black stripes (FIG. 9A) or members of a black matrix (FIG. 9B) depending on the arrangement of the fluorescent bodies.

Black stripes or members of a black matrix are arranged for a color display panel so that color mixing of the fluorescent members 92 of three different primary colors are made less discriminable and the adverse effect of reducing the contrast of displayed images on the fluorescent film 84 by reflected external light is weakened by blackening the surrounding areas.

While graphite is normally used as a principal ingredient of the black stripes, other conductive material having low light transmissivity and reflectivity may alternatively be used.

A precipitation or printing technique is suitably used for applying a fluorescent material on the glass substrate 93 regardless of black and white or color display.

An ordinary metal back 85 (FIG. 8) is arranged on the inner surface of the fluorescent film 84.

The metal back 85 is provided in order to enhance the luminance of the display panel by causing the rays of light emitted from the fluorescent bodies and directed to the inside of the envelope to turn back toward the face plate 86, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum evaporation after forming the fluorescent film.

A transparent electrode (not shown) may be formed on the face plate 86 facing the outer surface of the fluorescent film 84 in order to raise the conductivity of the fluorescent film 84.

The envelope 88 is evacuated by way of an exhaust pipe (not shown) until the atmosphere in the inside is reduced to a degree of vacuum of $10^{-7}$ torr. A getter process may be conducted in order to maintain the achieved degree of vacuum in the inside of the envelope 88 after it is sealed.

In a getter process, a getter arranged at a predetermined position in the envelope 88 is heated by means of a resistance heater or a high frequency heater to form an evaporation film immediately before or after the envelope 88 is sealed.

A getter typically contains Ba as a principal ingredient and can maintain a degree of vacuum between $1\times10^{-5}$ and $1\times10^{-7}$ torr by the adsorption effect of the evaporation film. The process steps of manufacturing surface conduction electron-emitting devices of the image forming apparatus after the forming process may appropriately be designed to meet the specific requirements of the intended application.

Now, a drive circuit for driving a display panel comprising an electron source with a simple matrix arrangement for displaying television images according to NTSC television signals will be described by referring to FIG. 10.

In FIG. 10, reference numeral 101 denotes a display panel. Otherwise, the circuit comprises a scan circuit 102, a control circuit 103, a shift register 104, a line memory 105, a synchronizing signal separation circuit 106 and a modulation signal generator 107. Vx and Va in FIG. 10 denote DC voltage sources.

The display panel 101 is connected to external circuits via terminals Dox1 through Doxm, Doy1 through Doyn and high voltage terminal Hv, of which terminals Dox1 through Doxm are designed to receive scan signals for sequentially driving on a one-by-one basis the rows (of N devices) of an electron source in the apparatus comprising a number of surface conduction electron-emitting devices arranged in the form of a matrix having M rows and N columns.

On the other hand, terminals Doy1 through Doyn are designed to receive a modulation signal for controlling the output electron beam of each of the surface conduction electron-emitting devices of a row selected by a scan signal. High voltage terminal Hv is fed by the DC voltage source Va with a DC voltage of a level typically around 10 kV, which is sufficiently high to energize the fluorescent bodies of the selected surface conduction electron-emitting devices.

The scan circuit 102 operates in a manner as follows. The circuit comprises M switching devices (of which only devices S1 and Sm are specifically indicated in FIG. 10), each of which takes either the output voltage of the DC voltage source Vx or 0[V] (the ground potential level) and comes to be connected with one of the terminals Dox1 through Doxm of the display panel 101.

Each of the switching devices S1 through Sm operates in accordance with control signal Tscan fed from the control circuit 103 and can be prepared by combining transistors such as FETs.

The DC voltage source Vx of this circuit is designed to output a constant voltage such that any drive voltage applied to devices that are not being scanned due to the performance of the surface conduction electron-emitting devices (or the threshold voltage for electron emission) is reduced to less than threshold voltage.

The control circuit 103 coordinates the operations of related components so that images may be appropriately displayed in accordance with externally fed video signals. It generates control signals Tscan, Tsft and Tmry in response to synchronizing signal Tsync fed from the synchronizing signal separation circuit 106, which will be described below.

The synchronizing signal separation circuit 106 separates the synchronizing signal component and the luminance signal component form an externally fed NTSC television signal and can be easily realized using a popularly known frequency separation (filter) circuit.

Although a synchronizing signal extracted from a television signal by the synchronizing signal separation circuit 106 is constituted, as well known, of a vertical synchronizing signal and a horizontal synchronizing signal, it is simply designated as Tsync signal here for convenience sake, disregarding its component signals.

On the other hand, a luminance signal drawn from a television signal, which is fed to the shift register 104, is designed as DATA signal.

The shift register 104 carries out for each line a serial/parallel conversion on DATA signals that are serially fed on a time series basis in accordance with control signal Tsft fed from the control circuit 103. (In other words, a control signal Tsft operates as a shift clock for the shift register 104.) A set of data for a line that have undergone a serial/parallel conversion (and correspond to a set of drive data for N electron-emitting devices) are sent out of the shift register 104 as N parallel signals Id1 through Idn.

The line memory 105 is a memory for storing a set of data for a line, which are signals Id1 through Idn, for a required period of time according to control signal Tmry coming from the control circuit 103. The stored data are sent out as I'dl through I'dn and fed to modulation signal generator 107.

Said modulation signal generator 107 is in fact a signal source that appropriately drives and modulates the operation of each of the surface-conduction type electron-emitting devices and output signals of this device are fed to the surface-conduction type electron-emitting devices in the display panel 101 via terminals Dol1 through Doyn.

As described above, an electron-emitting device, to which the present invention is applicable, is characterized by the following features in terms of emission current Ie. Firstly, there exists a clear threshold voltage Vth and the device emit electrons only a voltage exceeding Vth is applied thereto (FIG. 6).

Secondly, the level of emission current Ie changes as a function of the change in the applied voltage above the threshold level Vth, although the value of Vth and the relationship between the applied voltage and the emission current may vary depending on the materials, the configuration and the manufacturing method of the electron-emitting device.

More specifically, when a pulse-shaped voltage is applied to an electron-emitting device according to the invention, practically no emission current is generated so far as the applied voltage remains under the threshold level, whereas an electron beam is emitted once the applied voltage rises above the threshold level.

It should be noted here that the intensity of an output electron beam can be controlled by changing the peak level Vm of the pulse-shaped voltage.

Additionally, the total amount of electric charge of an electron beam can be controlled by varying the pulse width Pw.

Thus, either modulation method or pulse width modulation may be used for modulating an electron-emitting device in response to an input signal. With voltage modulation, a voltage modulation type circuit is used for the modulation signal generator 107 so that the peak level of the pulse shaped voltage is modulated according to input data, while the pulse width is held constant. With pulse width modulation, on the other hand, a pulse width modulation type circuit is used for the modulation signal generator 107 so that the pulse width of the applied voltage may be modulated according to input data, while the peak level of the applied voltage is held constant.

As described above, an image-forming apparatus according to the invention can display television images by means of the above described drive operation.

Although it is not particularly mentioned above, the shift register 104 and the line memory 105 may be either of digital or of analog signal type so long as serial/parallel conversions and storage of video signals are conducted at a given rate.

If digital signal type devices are used, output signal DATA of the synchronizing signal separation circuit 106 needs to be digitized. However, such conversion can be easily carried out by arranging an A/D converter at the output of the synchronizing signal separation circuit 106. It may be needless to say that different circuits may be used for the modulation signal generator 107 depending on if output signals of the line memory 105 are digital signals or analog signals.

If digital signals are used, a D/A converter circuit of a known type may be used for the modulation signal generator 107 and an amplifier circuit may additionally be used, if necessary.

As for pulse width modulation, the modulation signal generator 107 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 107 and a level shift circuit may be added thereto if necessary. As for pulse width modulation, a known voltage control type oscillation circuit (VCO) may be used with, if necessary, an additional amplifier to be used for voltage amplification up to the drive voltage of surface conduction type electron-emitting device.

With an image forming apparatus having a configuration as described above, to which the present invention is applicable, the electron-emitting devices emit electrons as a voltage is applied thereto by way of the external terminals Dox1 through Doxm and Doy1 through Doyn. Then, the generated electron beams are accelerated by applying a high voltage to the metal back 35 or a transparent electrode (not shown) by way of the high voltage terminal Hv. The accelerated electrons eventually collide with the fluorescent film 84, which by turn glows to produce images.

The above described configuration of image forming apparatus is only an example to which the present invention is applicable and may be subjected to various modifications. The TV signal system to be used with such an apparatus is not limited to NTSC and any system such as PAL or SECAM may feasibly be used with it. It is particularly suited for TV signals involving a larger number of scanning lines (typically of a high definition TV system such as the MUSE system) because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 11 and 12.

Figure 11:
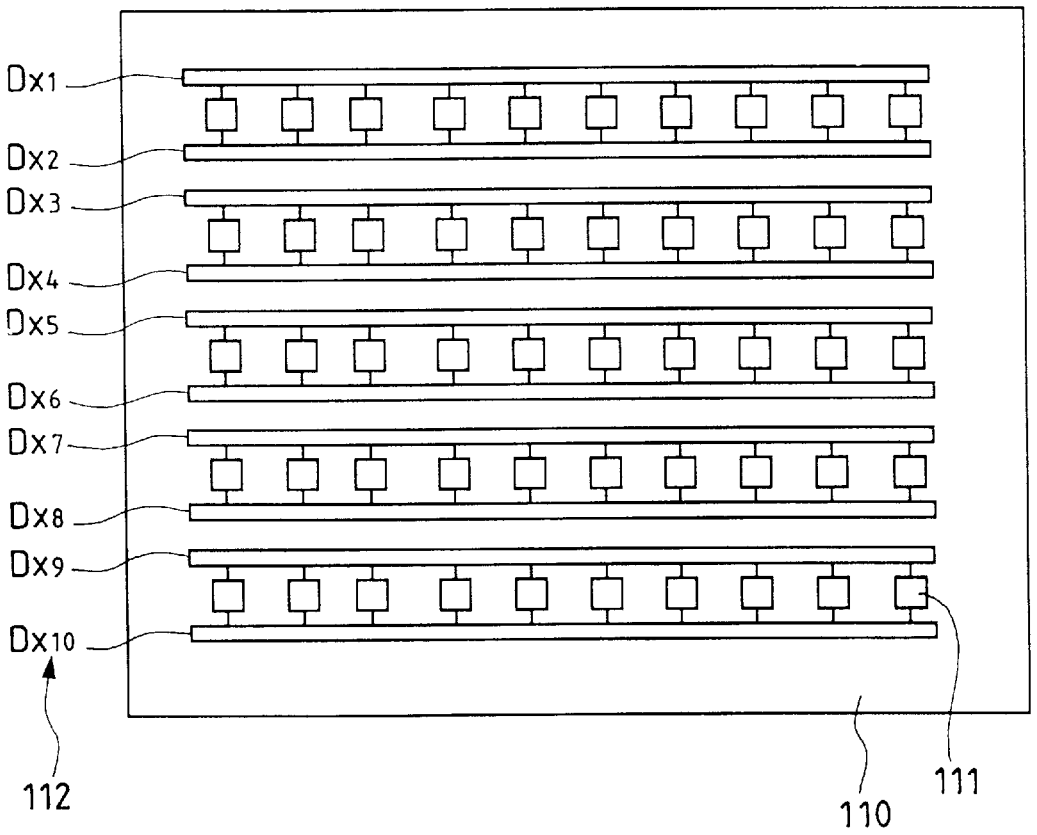
FIG. 11 is a schematic plan view of an electron source having a ladder-like arrangement.

Firstly referring to FIG. 11, reference numeral 110 denotes an electron source substrate and reference numeral 111 denotes a surface conduction electron-emitting device arranged on the substrate, whereas reference numeral 112 generally denotes common wires Dx1 through Dx10 for connecting the surface conduction electron-emitting devices. The electron-emitting devices 111 are arranged on the substrate 110 in rows along the X-direction (to be referred to as device rows hereinafter) to form a ladder-type electron source comprising a plurality of device rows, each row having a plurality of devices.

The surface conduction electron-emitting devices of each device row can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wiring. Thus, of the common wirings Dx2 through Dx9, Dx2 and Dx3 can share a single common wiring instead of two wirings.

Figure 12:
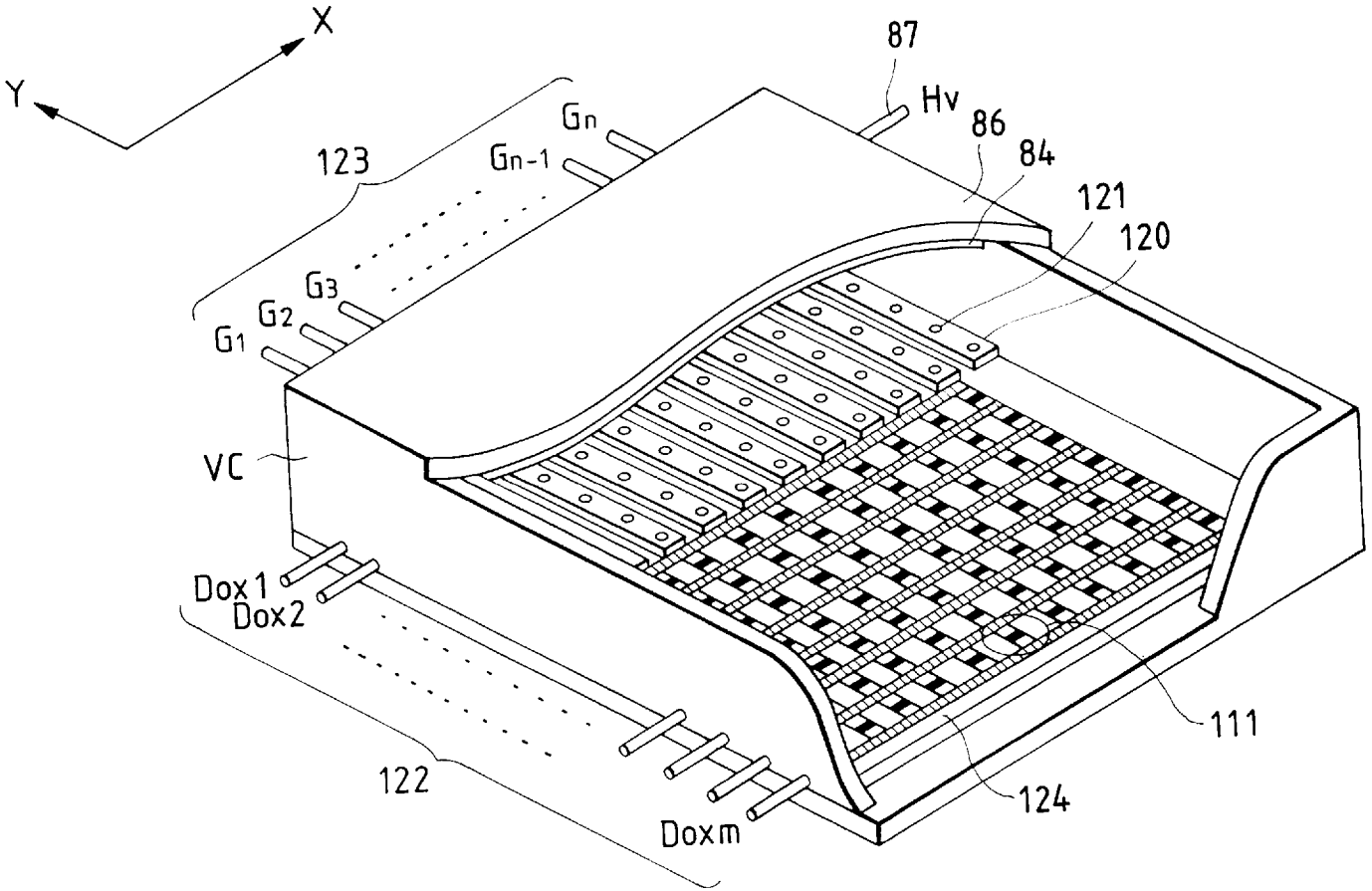
FIG. 12 is a schematic perspective view of an image-forming apparatus.
Figure 13:
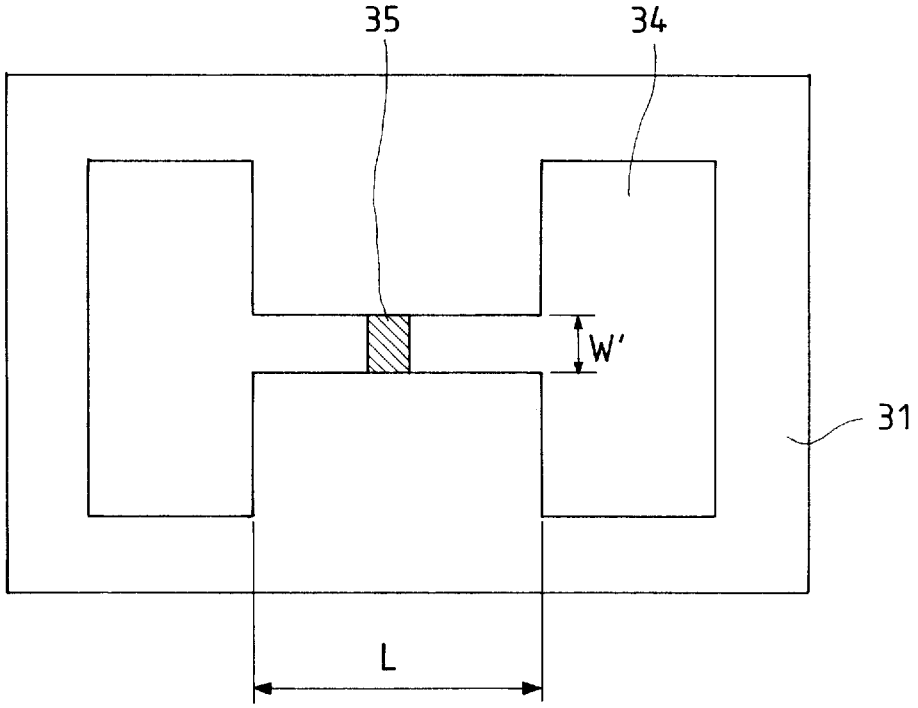
FIG. 13 is a schematic plan view of a conventional surface conduction electron-emitting device.

FIG. 12 is a schematic perspective view of an image-forming apparatus incorporating an electron source having a ladder-like arrangement of electron-emitting devices. In FIG. 12, it comprises grid electrodes 120, each provided with a number of bores 121 for allowing electrons to pass therethrough and a set of external terminals Dox1, Dox2, . . . , Doxm, which are generally denoted by reference numeral 122, along with another set of external terminals G1, G2, . . . , Gn, which are generally denoted by reference numeral 123 and connected to the respective grid electrodes 120 and an electron source substrate 124 having common wires for connecting device rows. Note that, in FIG. 12, the components that are similar to those of FIGS. 8 and 11 are respectively denoted by the same reference symbols.

The image forming apparatus differs from the image forming apparatus with a simple matrix arrangement (FIG. 8) mainly in that the apparatus of FIG. 12 has grid electrodes 120 arranged between the electron source substrate 110 and the face plate 86.

In FIG. 12, the stripe-shaped grid electrodes 120 are arranged between the substrate 110 and the face plate 86 for modulating electron beams emitted from the surface conduction electron-emitting devices, each provided with through bores 121 in correspondence to respective electron-emitting devices for allowing electron beams to pass therethrough.

Note that, however, while stripe-shaped grid electrodes are shown in FIG. 12, the profile and the locations of the electrodes are not limited thereto. For example, they may alternatively be provided with mesh-like openings and arranged around or close to the surface conduction electron-emitting devices.

The external terminals 122 and the external terminals for the grids 123 are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as a terminal apparatus for a computer system, as an optical printer comprising a photosensitive drum and in many other ways.

For the purpose of the present invention, the electron-emitting devices may not necessarily be surface conduction electron-emitting devices but MIM type electron-emitting devices or field emission-type electron-emitting devices may alternatively be used for a cold cathode electron source. Alternatively, a thermionic cathode electron source may be used for an image-forming apparatus according to the invention.

Now, the present invention will be described by way of examples.

Example 1

Electroconductive frit comprising an electroconductive filler consisting of Au plated soda lime glass granules was prepared.

The soda lime glass granules used as the base material of the electroconductive filler had an average diameter of 15 $\mu$m and a good granule dimensional distribution. The surface of the soda lime glass granules was plated with an under coat of Ni film to a thickness of 0.1 $\mu$m and then with Au to a thickness of 0.02 $\mu$m to make the filler electroconductive.

The electroconductive filler was then mixed with powdery frit glass that contained no filler to a mixing ratio of 40% by weight to produce powdery electroconductive frit.

The prepared electroconductive frit was then combined with a vehicle of a solvent of terpineol dissolving therein an acrylic resin binding agent (caulking material) to produce pasty electroconductive frit that could be easily applied.

The paste of electroconductive frit was then applied to a soda lime glass plate by means of a dispenser and baked in an air-containing electric furnace at a maximum temperature of 400° C. to 450° C.

The baked electroconductive frit showed a sufficient securing strength relative to the soda lime glass and a volume resistivity of lmQcm, which was satisfactory for electric connection.

Example 2

Electroconductive frit comprising an electroconductive filler consisting of Ag plated silica ($SiO_2$) granules was prepared.

The silica granules used as the base material of the electroconductive filler had an average diameter of 10 μm and a good granule dimensional distribution. The surface of the silica granules was plated with an under coat of Ni film to a thickness of 0.1 μm and then with Ag to a thickness of 0.03 μm to make the filler electroconductive.

The electroconductive filler was then mixed with powdery frit glass that contained no filler to a mixing ratio of 30% by weight to produce powdery electroconductive frit.

The prepared electroconductive frit was then combined with a vehicle of a solvent of terpineol dissolving therein an acrylic resin binding agent (caulking material) to produce pasty electroconductive frit that could be easily applied. The paste of electroconductive frit was then applied to a soda lime glass plate and baked as in the case of Example 1.

The baked electroconductive frit showed a sufficient securing strength relative to the soda lime glass and a volume resistivity of tens of several mΩcm, which was satisfactory for electric connection.

Example 3

Electroconductive frit according to the invention was used to assemble a matrix type electron source substrate and a face plate to produce an image-forming apparatus.

Figure 14:
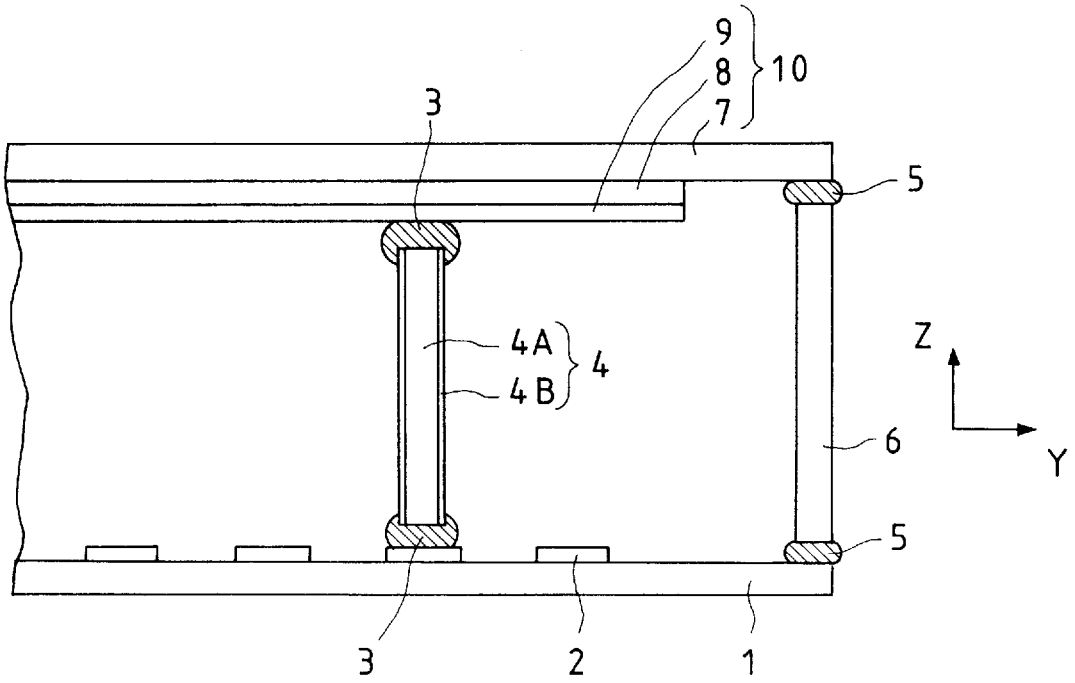
FIG. 14 is a schematic partial cross sectional view of an image-forming apparatus according to the invention.

FIG. 8 shows a partially cut-out schematic perspective view of the image-forming apparatus of this example and FIG. 14 shows a partial cross sectional view of the image-forming apparatus taken along line A-A' in FIG. 8. Referring to FIG. 14, there are shown an electroconductive spacer 4 prepared by forming a semiconductor thin film 4B on the surface of a soda lime glass plate 4A, pieces of electroconductive frit 3, an electron source substrate (of soda lime glass) 1 having X-directional wires 2, a face plate 10 including a soda lime glass substrate 7, a fluorescent film 8 and a metal back 9 and a support frame 6.

The electroconductive spacer and other spacers were secured and electrically connected to the electron source substrate 1 and the face plate 10 by applying the electroconductive frit paste of Example 1 by means of a dispenser, preliminarily baking it and bonding it to the substrate 1 and the face plate 10. The support frame 6 was simultaneously bonded to the substrate 1 and the face plate 10 by means of pieces of ordinary insulating frit 5.

The electroconductive spacers 4 of the prepared image-forming apparatus showed a satisfactory securing strength and electric connectability.

If the electric connection of the spacers 4 with the substrate 1 and the face plate 10 is not sufficient, the spacers can be electrically charged to alter the electric fields they produce and hence the trajectories of electrons so that the positions and the profile of the fluorescing spots of the fluorescent body can be modified. If, on the other hand, the securing strength is not sufficient, the spacer may not be able to withstand the atmospheric pressure. However, the spacers of this example were totally free from these problems.

Example 4

An image-forming apparatus comprising a ladder-type electron source substrate was prepared.

In this example, electroconductive cylindrical spacers made of soda lime glass and coated with a semiconductor thin film were used in this example. The electroconductive spacers were secured and electrically connected to a substrate and a face plate by means of the electroconductive frit prepared in Example 2. As in the case of Example 3, the electroconductive spacers of the prepared image-forming apparatus showed a satisfactory securing strength and electric connectability and operated as effective as those of Example 3.

Example 5

Low melting point glass powder and an electroconductive filler material were mixed in varied weight % ratios as shown in Table 1and the mixtures were tested for bonding strength and volume resistivity. The test results are also shown in Table 1. The bonding strength was tested by way of a shearing friction test, using a tension tester (available from Orientec Co., Ltd.) and the volume resistivity was tested by means of a thin film test, using a high resistance.

LS0200 (tradename: available from Japan Electric Glass Co., Ltd.) was used for the low melting point glass of this example. Granular silica pellets ($SiO_2$) having an average diameter of 42 μm and a maximum diameter of 60 μm were used as the base material of the electroconductive filler. They showed a good dimensional distribution. The silica pellets were electrolessly plated to form on the surface thereof an under coat of Ni to a film thickness of 0.1 μm and an Au over layer to a film thickness of 0.03 μm. They were used as an electroconductive filler. The mixed powdery electroconductive glass was then baked to 400° C. to 450° C. for evaluation. It will be seen from Table 1 that the content of the electroconductive filler is between 3 and 95%, preferably between 10 and 60%, and optimally between 10 and 25%, in order to produce electroconductive frit that is satisfactory in terms of both bonding strength and volume specific electric resistance.

Example 6

Granular silica pellets having an average diameter of 23 μm and a maximum diameter of 48 μm were used as the base material of the electroconductive filler of the example. They showed a good dimensional distribution. The silica pellets were electrolessly plated to form on the surface thereof an under coat of Ni to a film thickness of 0.1 μm and an Au over layer to a film thickness of 0.02 μm. They were used as an electroconductive filler.

Low melting point glass powder (LS3000: noncrystalline glass (containing PbO, $B_2O_3$ and $TiO_2$ as principal ingredients) available from Japan Electric Glass Co., Ltd.) was mixed with the electroconductive filler added by a weight % ratio of 27%, to which a lowly expansive ceramic filler (zircon) was added by 10% by weight for adjusting the thermal expansion coefficient to produce powdery electroconductive frit.

The prepared powdery electroconductive frit was then combined with a vehicle of a solvent of terpineol dissolving therein an acrylic resin binding agent (caulking material) by weight 10% to a ratio of 1:12 by weight to produce pasty electroconductive frit that could be easily applied.

The paste of electroconductive frit was then applied to a soda lime glass plate by means of a dispenser, dried and preliminarily baked at 350° C. to 380° C. in the atmosphere to remove the vehicle. It was then baked at 400° C. to 450° C. in the air.

The baked electroconductive frit showed a sufficient securing strength relative to the soda lime glass and a volume resistivity of 30 mΩcm, which was excellent for electric connection.

Example 7

Granular soda lime glass pellets having an average diameter of 18 μm and a maximum diameter of 32 μm were used as the base material of the electroconductive filler of the example. They showed a good dimensional distribution. The soda lime glass pellets were plated to form on the surface thereof an under coat of Ni to a film thickness of 0.1 μm and an Ag over layer to a film thickness of 0.03 μm. They were used as an electroconductive filler.

Low melting point glass powder (LS6500: crystalline glass (containing PbO, $B_2O_3$ and ZnO as principal ingredients) available from Japan Electric Glass Co., Ltd.) was mixed with the electroconductive filler added by a weight % ratio of 38% to produce powdery electroconductive frit.

The prepared powdery electroconductive frit was then combined with a vehicle of a solvent of terpineol dissolving therein an acrylic resin binding agent (caulking material) by weight 10% to a ratio of 1:12 by weight to produce pasty electroconductive frit that could be easily applied.

The paste of electroconductive frit was then applied to a soda lime glass plate, dried and preliminarily baked at 350° C. to 380° C. in the atmosphere to remove the vehicle. It was then baked at 430° C. to 480° C. in the air.

The baked electroconductive frit showed a sufficient securing strength relative to the soda lime glass and a volume resistivity of 1 mΩcm, which was excellent for electric connection.

Example 8

Granular soda lime glass pellets having an average diameter of 12 μm and a maximum diameter of 32 μm were used as the base material of the electroconductive filler of the example. They showed a good dimensional distribution. The soda lime glass pellets were plated to form on the surface thereof an under coat of Ni to a film thickness of 0.15 μm and an Au over layer to a film thickness of 0.05 μm. They were used as an electroconductive filler.

Low melting point glass powder (LS3000: noncrystalline glass (containing PbO, $B_2O_3$ and $TiO_2$ as principal ingredients) available from Japan Electric Glass Co., Ltd.) was mixed with the electroconductive filler added by a weight % ratio of 52%, to which a lowly expansive ceramic filler (zircon) was added by 6% by weight for adjusting the termal expansion coefficient to produce powdery electroconductive frit.

The prepared powdery electroconductive frit was then combined with a vehicle of a solvent of terpineol dissolving therein an acrylic resin binding agent (caulking material) by weight 10% to a ratio of 1:12 by weight to produce pasty electroconductive frit that could be easily applied.

The paste of electroconductive frit was then applied to a soda lime glass plate, dried and preliminarily baked at 350° C. to 380° C. in the atmosphere to remove the vehicle. It was then baked at 400° C. to 450° C. in the air.

The baked electroconductive frit showed a sufficient securing strength relative to the soda lime glass and a volume resistivity of 0.5 mΩcm, which was excellent for electric connection.

Example 9

In this example, an image-forming apparatus having a configuration as shown in FIG. 8 was prepared by using electroconductive frit according to the invention.

Figure 15A:
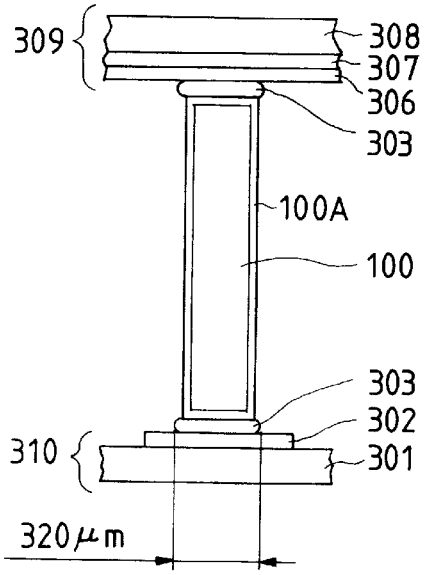
FIGS. 15A and 15B are schematic partial cross sectional views of an image-forming apparatus according to the invention.
Figure 15B:
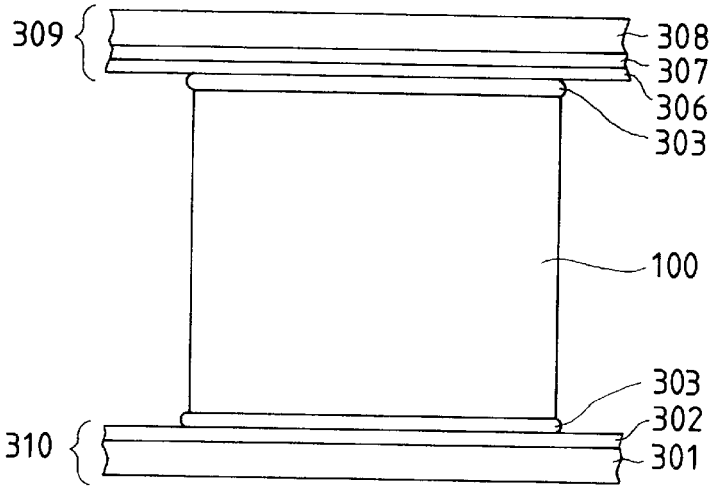

FIGS. 15A and 15B are partial cross sectional views taken along lines A–A' and B–B' in FIG. 8 respectively.

In FIGS. 15A and 15B, there are shown an electroconductive spacer 100 prepared by forming a semiconductor film 100A on the surface of a soda lime glass plate, pieces of electroconductive frit 303 for bonding the electroconductive spacer having a width of 320 μm, an electron source substrate 310 made of a soda lime glass substrate 301 and carrying thereon X-directional wires 302 and a face plate 309 having a soda lime glass substrate 308, a fluorescent film 307 and a metal back 306. The electroconductive frit 303 was the pasty electroconductive frit of Examples 5 through 8, which was applied to the metal back 306 and the X-directional wires 302 by means of a dispenser and preliminarily baked. Then, the spacer 100 was aligned with the metal back 306 and pressed against the metal back 306 at a side thereof before it was baked to electrically connect and mechanically secure it to the metal back. Thereafter, it was aligned with the corresponding X-directional wire 302, pressed against it at a side thereof and baked to electrically connect and mechanically secure it to the wire. The image-forming apparatus was prepared after completing these procedures.

The electroconductive spacers of the prepared image-forming apparatus showed a satisfactory mechanical securing strength and a good electric connectability.

If the electric connection of the spacers with the substrate 1 and the face plate is not sufficient, the spacers can be electrically charged to alter the electric fields they produce and hence the trajectories of electrons so that the positions and the profile of the fluorescing spots of the fluorescent body can be modified. If, on the other hand, the securing strength is not sufficient, the spacer may not be able to withstand the atmospheric pressure. However, the spacers of this example were totally free from these problems.

Example 10

In this example, an image-forming apparatus having a configuration as shown in FIG. 8 was prepared by using electroconductive frit according to the invention.

Figure 16A:
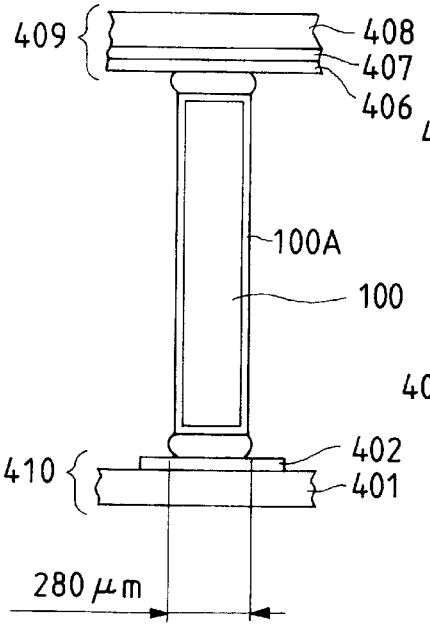
FIGS. 16A through 16C are schematic partial cross sectional views of an image-forming apparatus according to the invention.
Figure 16B:
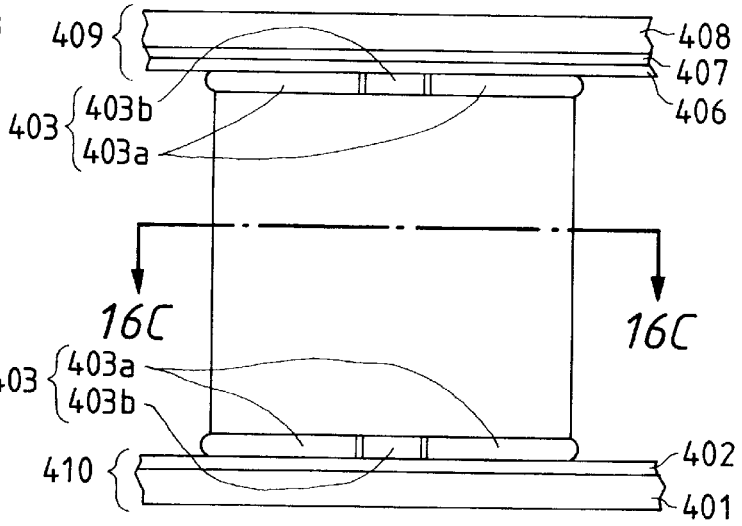
Figure 16C:
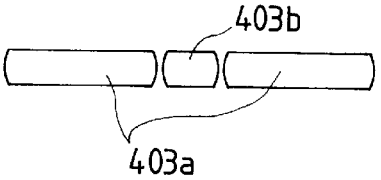

FIGS. 16A and 16B are partial cross sectional views taken along lines A–A' and B–B' in FIG. 8 respectively and FIG. 16C is a cross sectional view of the electroconductive frit applied there and taken along line 16C—16C in FIG. 16B.

In FIGS. 16A through 16C, there are shown an electroconductive spacer 100 prepared by forming a semiconductor film 100A on the surface of a soda lime glass plate, bonding members 403 to be used for the electroconductive spacer, each of said bonding members including a piece of electroconductive frit 403*a* prepared in Examples 5 through 8 and having a width of 250 μm and pieces of crystalline frit glass having a width of 250 μm, an electron source substrate 410 made of a soda lime glass substrate 401 and carrying thereon X-directional wires 402 and a face plate 409 having a soda lime glass substrate 408, a fluorescent film 407 and a metal back 406.

As seen from FIGS. 16A through 16C, the electroconductive frit 403*a* was pasty electroconductive frit applied to the metal back 406 and the X-directional wire 402 by means of a dispenser, whereas crystalline frit glass 403*b* (LS7107: available from Japan Electric Glass Co., Ltd.) was applied to a central portion of the area to be covered by the spacer 100 and not applied by the electroconductive frit 403*a* also by means of a dispenser. The applied two types of frit were then preliminarily baked.

Thereafter, the spacer 100 was aligned with the metal back 406, pressed against the metal back 406 at a side thereof and baked to electrically connected to the metal back by frit 403*a* and mechanically secured by frit 403*b* . Thereafter, it was aligned with the corresponding X-directional wire 402, pressed against it at a side thereof and baked so that the X-directional wire 402 and the spacer 100 were electrically connected by the frit 403 and mechanically secured to each other by the frit 403. The image-forming apparatus was prepared after completing these procedures.

In short, in the example, the face plate, the electron source substrate and the spacers of the image-forming apparatus were electrically connected by electroconductive frit according to the invention and mechanically secured to each other by crystalline frit glass.

The electroconductive spacers of the prepared image-forming apparatus showed a satisfactory mechanical securing strength and a good electric connectability.

If the electric connection of the spacers with the substrate 1 and the face plate is not sufficient, the spacers can be electrically charged to alter the electric fields they produce and hence the trajectories of electrons so that the positions and the profile of the fluorescing spots of the fluorescent body can be modified. If, on the other hand, the securing strength is not sufficient, the spacer may not be able to withstand the atmospheric pressure. However, the spacers of this example were totally free from these problems.

Example 11

In this example, an image-forming apparatus having a configuration as shown in FIG. 8 was prepared by using electroconductive frit according to the invention.

Figure 17A:
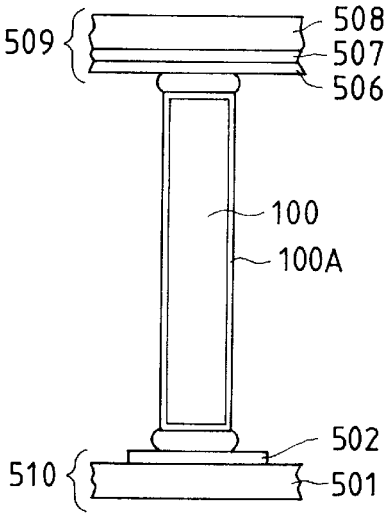
FIGS. 17A through 17C are schematic partial cross sectional views of an image-forming apparatus according to the invention.
Figure 17B:
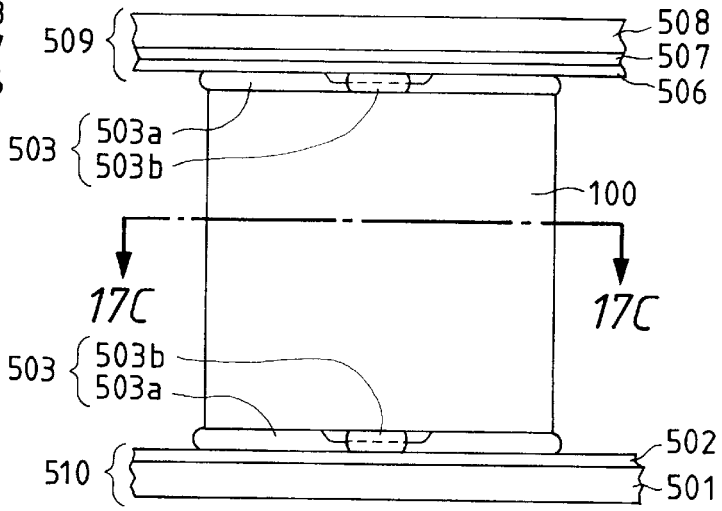
Figure 17C:
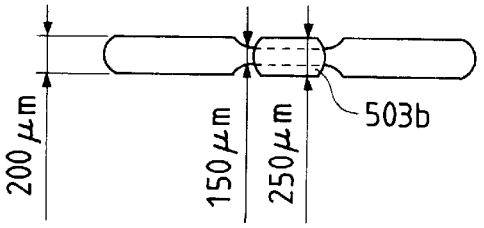

FIGS. 17A and 17B are partial cross sectional views taken along lines A–A' and B–B' in FIG. 8 respectively and FIG. 17C is a cross sectional view of the electroconductive frit applied there and taken along line 17C—17C in FIG. 17B.

In FIGS. 17A through 17C, there are shown an electroconductive spacer 100 prepared by forming a semiconductor film 100A on the surface of a soda lime glass plate, bonding members 503 to be used for the electroconductive spacer, each of said bonding members including a piece of electroconductive frit 503*a* prepared in Examples 5 through 8 and having a width of 250 m and pieces of noncrystalline frit glass having a width of 150 to 200 $\mu$m, an electron source substrate 510 made of a soda lime glass substrate 501 and carrying thereon X-directional wires 502 and a face plate 509 having a soda lime glass substrate 508, a fluorescent film 507 and a metal back 506.

As seen from FIGS. 17A through 17C, noncrystalline frit glass (LS3081: available from Japan Electric Glass Co., Ltd.) was applied by means of a dispenser to the metal back 506 and the X-directional wire 502 at a central portion of the area to be covered by the spacer 100 by means of a dispenser in order to reduce the cross section, whereas pasty electroconductive frit of Example 8was applied to the area having a reduced cross section also by means of a dispenser. The applied two types of frit were then preliminarily baked.

Thereafter, the spacer 100 was aligned with the metal back 506, pressed against the metal back 506 at a side thereof and baked so that the metal back 506 and the spacer 100 were electrically connected by frit 503*a* and mechanically secured to each other by frit 503*b*. Then, it was aligned with the corresponding X-directional wire 502, pressed against it at the other side thereof and baked so that the X-directional wire 402 and the spacer 100 were electrically connected by the frit 503*a* and mechanically secured to each other by the frit 503*b*. The image-forming apparatus was prepared after completing these procedures.

In short, in the example, the face plate, the electron source substrate and the spacers of the image-forming apparatus were electrically connected by electroconductive frit according to the invention and mechanically secured to each other by noncrystalline frit glass.

The electroconductive spacers of the prepared image-forming apparatus showed a satisfactory mechanical securing strength and a good electric connectability.

If the electric connection of the spacers with the substrate 1 and the face plate is not sufficient, the spacers can be electrically charged to alter the electric fields they produce and hence the trajectories of electrons so that the positions and the profile of the fluorescing spots of the fluorescent body can be modified. If, on the other hand, the securing strength is not sufficient, the spacer may not be able to withstand the atmospheric pressure. However, the spacers of this example were totally free from these problems.

TABLE 1

| electroconductive filler content (%) | 1 | 3 | 5 | 10 | 20 | 25 | 40 | 60 | 95 | 98 |
|---|---|---|---|---|---|---|---|---|---|---|
| adhesion strength | D | B-C | B | A | A | A | B | B | B-C | D |
| volume resistivity | D | B-C | B | A | A | A | A | A | A | D |

N.B.:
A: excellent
B: good
C: fair
D: unmeasurable

What is claimed is:

1.Electroconductive frit comprising:

a low melting point glass;

a fine glass particle filler; and a metal forming a layer on a surface of said fine glass particle filler, wherein said metal is disposed only on said surface.

2. Electroconductive frit according to claim 1, wherein said frit further comprises a ceramic filler having a lower thermal expansion coefficient than said fine glass particle filler.

3. Electroconductive frit according to claim 2, wherein said ceramic filler has a thermal expansion coefficient of less than $70\times10^{-7}$° C.$^{-1}$.

4. Electroconductive frit according to claim 2, wherein said ceramic filler comprises at least one material selected from zircon, lead titanate, aluminum titanate, alumina, mullite, cordierite, β-eucryptite and β-spodumene.

5. Electroconductive frit according to claim 1, wherein said metal layer has a double-layered structure of two different metals formed on the surface of said fine glass particle filler.

6. Electroconductive frit according to claim 5, wherein the outer layer of said double-layered structure comprises one metal selected from Cu, Ni, Cr, Au, Ag and Pt.

7. Electroconductive frit according to claim 1, wherein said metal layer is formed on the fine glass particle filler by plating.

8. Electroconductive frit according to claim 1, wherein said metal layer formed on the fine glass particle filler has a thickness between 0.005 and 1 $\mu$m.

9. Electroconductive frit according to claim 8, wherein said metal layer formed on the fine glass particle filler has a thickness between 0.02 and 0.1 $\mu$m.

10. Electroconductive frit according to claim 1, wherein said fine glass particle filler having said metal layer is added to said low melting point glass in an amount from 3 to 95% by weight.

11. Electroconductive frit according to claim 10, wherein said fine glass particle filler having said metal layer is added to said low melting point glass in an amount from 5 to 40% by weight.

12. Electroconductive frit according to claim 11, wherein said fine glass particle filler having said metal layer is added to said low melting point glass in an amount from 10 to 25% by weight.

13. Electroconductive frit according to claim 1, wherein said electroconductive frit shows a volume resistivity between $10^{-5}$ and $10^{4}$ Ωcm.

14. Electroconductive frit according to claim 1, wherein said electroconductive frit shows a volume resistivity between $10^{-3}$ and $10^{10}$ Ωcm.

15. Electroconductive frit according to claim 1, wherein said fine glass particle filler comprises silica or soda lime glass.

16. Electroconductive frit according to claim 1, wherein said fine glass particle filler is formed of spherical particles.

17. Electroconductive frit according to claim 16, wherein said spherical particle have an average diameter between 5 and 50 μm.

18. Electroconductive frit according to claim 1, wherein said electroconductive frit further comprises a vehicle and is made pasty.

19. Electroconductive frit according to claim 1, wherein said low melting point glass comprises a noncrystalline glass.

20. Electroconductive frit according to claim 1, wherein said low melting point glass comprises a crystalline glass.

21. An image-forming apparatus comprising a face plate having a fluorescent body and an electron accelerating electrode, an electron source substrate disposed opposite the face plate and having electron source and an electroconductive spacer disposed between said face plate and said electron source substrate, wherein said face plate and said spacer are mechanically secured by means of an electroconductive frit according to claim 1.

22. An image-forming apparatus according to claim 21, wherein said accelerating electrode and said electroconductive spacer are electrically connected by means of said electroconductive frit.

23. An image-forming apparatus according to claim 21, wherein said accelerating electrode comprises a metal back.

24. An image-forming apparatus according to claim 21, wherein said face plate and said electroconductive spacer are mechanically secured by means of crystallized or noncrystallized frit in addition to said electroconductive frit.

25. An image-forming apparatus according to claim 21, wherein said electron source comprises a cold cathode electron source.

26. An image-forming apparatus according to claim 25, wherein said cold cathode electron source comprises field emitters.

27. An image-forming apparatus according to claim 25, wherein said cold cathode electron source comprises metal/insulating layer/metal type electron emitters.

28. An image-forming apparatus according to claim 25, wherein said cold cathode electron source comprises surface conduction electron-emitting devices.

29. An image-forming apparatus according to claim 21, wherein said electroconductive spacer comprises a glass member and a semiconductor thin film formed on said glass member.

30. An image-forming apparatus according to claim 29, wherein said semiconductor thin film comprises $SnO_2$.

31. An image-forming apparatus according to claim 29, wherein said glass member comprises soda lime glass.

32. An image-forming apparatus according to claim 21, wherein said electroconductive spacer has a plate-like shape.

33. An image-forming apparatus according to claim 21, wherein said electroconductive spacer has a columnar shape.

34. An image-forming apparatus according to claim 21, wherein said electron source substrate comprises a soda lime glass plate and an electron source formed thereon.

35. An image-forming apparatus according to claim 21, wherein said face plate comprises a soda lime glass plate.

36. An image-forming apparatus according to claim 21, wherein said apparatus further comprises a support frame for forming a sealed space between said electron source substrate and said face plate and said support frame is bonded to said electron source substrate and said face plate by means of an insulating frit.

37. An image-forming apparatus comprising a face plate having a fluorescent body and an electron accelerating electrode, an electron source substrate disposed opposite the face plate and having an electron source and a wire and an electroconductive spacer disposed between said face plate and said electron source substrate, wherein said electron source substrate and said spacer are mechanically secured by means of an electroconductive frit according to claim 1.

38. An image-forming apparatus according to claim 31, wherein said wire and said electroconductive spacer are electrically connected by means of said electroconductive frit.

39. An image-forming apparatus according to claim 37, wherein said accelerating electrode comprises a metal back.

40. An image-forming apparatus according to claim 37, wherein said electron source substrate and said electroconductive spacer are mechanically secured by means of a crystallized or noncrystallized frit in addition to said electroconductive frit.

41. An image-forming apparatus according to claim 37, wherein said electron source comprises a cold cathode electron source.

42. An image-forming apparatus according to claim 41, wherein said cold cathode electron source comprises field emitters.

43. An image-forming apparatus according to claim 41, wherein said cold cathode electron source comprises metal/insulating layer/metal type electron emitters.

44. An image-forming apparatus according to claim 41, wherein said cold cathode electron source comprises surface conduction electron-emitting devices.

45. An image-forming apparatus according to claim 37, wherein said electroconductive spacer comprises a glass member and a semiconductor thin film formed on said glass member.

46. An image-forming apparatus according to claim 45, wherein said semiconductor thin film comprises $SnO_2$.

47. An image-forming apparatus according to claim 45, wherein said glass member comprises soda lime glass.

48. An image-forming apparatus according to claim 37, wherein said electroconductive spacer has a plate-like shape.

49. An image-forming apparatus according to claim 37, wherein said electroconductive spacer has a columnar shape.

50. An image-forming apparatus according to claim 37, wherein said electron source substrate comprises a soda lime glass plate and an electron source formed thereon.

51. An image-forming apparatus according to claim 37, wherein said face plate comprises a soda lime glass plate.

52. An image-forming apparatus according to claim 37, wherein said apparatus further comprises a support frame for forming a sealed space between said electron source substrate and said face plate and said support frame is bonded to said electron source substrate and said face plate by means of an insulating frit.

* * * * *

UNITED STATES PATENT AND TRADEMARK OFFICE

CERTIFICATE OF CORRECTION

PATENT NO. : 5,770,918

DATED : June 23, 1998

INVENTOR(S) : SHINICHI KAWATE ET AL.

It is certified that error appears in the above-identified patent and that said Letters Patent is hereby corrected as shown below:

TITLE PAGE:

[56] REFERENCES CITED

Foreign Patent Documents
"02257551" should read --02-257551--.
"02299136" should read --02-299136--.

[30] FOREIGN APPLICATION PRIORITY DATA

Insert: --Jan. 6, 1995 [JP] Japan...7-000470--.

COLUMN 1

Line 43, "Advance in Electron Physics" should read --Advances in Electronics and Electron Physics--.
Line 50, "device" should read --devices--.

COLUMN 2

Line 52, Close up right margin.
Line 53, Close up left margin.

COLUMN 3

Line 60, "dissolved" should read --solved--.

COLUMN 4

Line 15, "dis-" should be deleted.

UNITED STATES PATENT AND TRADEMARK OFFICE

CERTIFICATE OF CORRECTION

PATENT NO. : 5,770,918

DATED : June 23, 1998

INVENTOR(S) : SHINICHI KAWATE ET AL.

It is certified that error appears in the above-identified patent and that said Letters Patent is hereby corrected as shown below:

COLUMN 5

Line 36, "metal" should read --metal 13 in a--.

COLUMN 6

Line 12, "if" should read --is--.

COLUMN 7

Line 39, "hundreds of several" should read --several hundred --; and "hun-" should be deleted.
Line 40, "dreds of several" should read --several hundred--.
Line 44, "hundreds of several" should read --several hundred --.
Line 46, "hundreds of several" should read --several hundred--.
Line 50, "hundres of several" should read --several hundred--.
Line 58, Close up right margin.
Line 59, Close up left margin.
Line 66, "a" should be deleted; and "thousands of" should read --several thousand--.
Line 67, "several "should be deleted.

UNITED STATES PATENT AND TRADEMARK OFFICE

CERTIFICATE OF CORRECTION

PATENT NO. : 5,770,918

DATED : June 23, 1998

INVENTOR(S) : SHINICHI KAWATE ET AL.

It is certified that error appears in the above-identified patent and that said Letters Patent is hereby corrected as shown below:

COLUMN 8

Line 16, "thousands of several" should read --several thousand--.
Line 22, "hundreds of several" should read --several hundred--.
Line 45, "hundreds of several" should read --several hundred--.
Line 46, "tens of several" should read --several tens of--.
Line 47, "hundreds of several" should read --several hundred--.
Line 50, "to between" should read --between--.

COLUMN 9

Line 39, "Ti" should read --T1--.
Line 46, "tens of several" should read --several tens of--.
Line 52, "an" should read --a--.
Line 53, "Ti" should read --T1--.

COLUMN 10

Line 59, "acceller-" should read --acceler---.

UNITED STATES PATENT AND TRADEMARK OFFICE

CERTIFICATE OF CORRECTION

PATENT NO. : 5,770,918

DATED : June 23, 1998

INVENTOR(S) : SHINICHI KAWATE ET AL.

It is certified that error appears in the above-identified patent and that said Letters Patent is hereby corrected as shown below:

COLUMN 12

Line 64, "FIG." should read --FIGS.--.

COLUMN 13

Line 49, "are" should read --is--.

COLUMN 15

Line 47, "Doll" should read --Doyl--.
Line 51, "emit" should read --emits--
Line 52, "only a" should read --when a--

COLUMN 16

Line 27, "DATA" should read --data--.
Line 33, "on if" should read --on whether--.

COLUMN 17

Line 2, "by" should read --in--.

COLUMN 18

Line 60, "1mQcm" should read --1mΩcm--.

UNITED STATES PATENT AND TRADEMARK OFFICE

CERTIFICATE OF CORRECTION

PATENT NO. : 5,770,918

DATED : June 23, 1998

INVENTOR(S) : SHINICHI KAWATE ET AL.

It is certified that error appears in the above-identified patent and that said Letters Patent is hereby corrected as shown below:

COLUMN 19

Line 18, "tens of several" should read --several tens of--.

COLUMN 20

Line 3, "effective" should read --effectively--.
Line 8, "1and" should read --1 and--.

COLUMN 21

Line 43, "termal" should read --thermal--.

COLUMN 22

Line 65, "to" should read --to be--.

COLUMN 23

Line 51, "8was" should read --8 was--.

COLUMN 24

Line 30, "1.Electroconductive" should read --1. Electroconductive--.
Line 43, "$70x10^{-7o}$ $C.^{-1}$." should read --$70x10^{-7}$ $°C.^{-1}$.--.

UNITED STATES PATENT AND TRADEMARK OFFICE

CERTIFICATE OF CORRECTION

PATENT NO. : 5,770,918

DATED : June 23, 1998

INVENTOR(S) : SHINICHI KAWATE ET AL.

It is certified that error appears in the above-identified patent and that said Letters Patent is hereby corrected as shown below:

COLUMN 25

Line 20, "particle" should read --particles--.

COLUMN 26

Line 22, "31" should read --37--.

Signed and Sealed this

Twenty-third Day of November, 1999

*Attest:*

Q. TODD DICKINSON

*Attesting Officer*

*Acting Commissioner of Patents and Trademarks*